US007583805B2

(12) United States Patent
Baumgarte et al.

(10) Patent No.: US 7,583,805 B2
(45) Date of Patent: Sep. 1, 2009

(54) LATE REVERBERATION-BASED SYNTHESIS OF AUDITORY SCENES

(75) Inventors: Frank Baumgarte, Sunnyvale, CA (US); Christof Faller, Tägerwilen (CH)

(73) Assignee: Agere Systems Inc., Allentown, PA (US)

( * ) Notice: Subject to any disclaimer, the term of this patent is extended or adjusted under 35 U.S.C. 154(b) by 1034 days.

(21) Appl. No.: 10/815,591

(22) Filed: Apr. 1, 2004

(65) Prior Publication Data

US 2005/0180579 A1 Aug. 18, 2005

Related U.S. Application Data

(60) Provisional application No. 60/544,287, filed on Feb. 12, 2004.

(51) Int. Cl.
*H03G 3/00* (2006.01)
*H04R 5/00* (2006.01)
*G10L 19/00* (2006.01)

(52) U.S. Cl. ..... 381/61; 381/62; 381/63; 381/1; 381/17; 381/18; 381/19; 381/20; 381/23; 381/21; 381/22; 704/200.1; 704/500

(58) Field of Classification Search ..... 381/61–63, 381/1, 17–23, 302–310; 704/200.1, 500.1, 704/E19.005, 500–504, 278, 201, 233
See application file for complete search history.

(56) References Cited

U.S. PATENT DOCUMENTS 4,236,039 A 11/1980 Cooper ..... 381/23
4,815,132 A 3/1989 Minami ..... 381/1
5,371,799 A * 12/1994 Lowe et al. ..... 381/310
5,463,424 A 10/1995 Dressler ..... 348/485
5,583,962 A 12/1996 Davis et al. ..... 395/2.38

(Continued)

FOREIGN PATENT DOCUMENTS

EP 1 376 538 A1 1/2004

(Continued)

OTHER PUBLICATIONS

"*Final text for DIS 11172-1 (rev. 2): Information Technology-Coding of Moving Pictures and Associated Audio for Digital Storage Media—Part 1*," ISO/IEC JTC 1/SC 29 N 147, Apr. 20, 1992, Section 3: Audio, XP-00203108, 2 pages.

(Continued)

*Primary Examiner*—Devona E. Faulk
(74) *Attorney, Agent, or Firm*—Mendelsohn, Drucker & Associates, PC; Steve Mendelsohn

(57) ABSTRACT

A scheme for stereo and multi-channel synthesis of inter-channel correlation (ICC) (normalized cross-correlation) cues for parametric stereo and multi-channel coding. The scheme synthesizes ICC cues such that they approximate those of the original. For that purpose, diffuse audio channels are generated and mixed with the transmitted combined (e.g., sum) signal(s). The diffuse audio channels are preferably generated using relatively long filters with exponentially decaying Gaussian impulse responses. Such impulse responses generate diffuse sound similar to late reverberation. An alternative implementation for reduced computational complexity is proposed, where inter-channel level difference (ICLD), inter-channel time difference (ICTD), and ICC synthesis are all carried out in the domain of a single short-time Fourier transform (STFT), including the filtering for diffuse sound generation.

49 Claims, 10 Drawing Sheets

U.S. PATENT DOCUMENTS

| | | | | |
|---|---|---|---|---|
| 5,682,461 | A | 10/1997 | Silzle et al. | 395/2.14 |
| 5,703,999 | A | 12/1997 | Herre et al. | 395/2.12 |
| 5,771,295 | A | 6/1998 | Waller, Jr. | 381/18 |
| 5,812,971 | A | 9/1998 | Herre | 704/230 |
| 5,825,776 | A | 10/1998 | Moon | 370/437 |
| 5,878,080 | A | 3/1999 | Ten Kate | 375/241 |
| 5,889,843 | A | 3/1999 | Singer et al. | 379/202.01 |
| 5,890,125 | A | 3/1999 | Davis et al. | 704/501 |
| 5,930,733 | A | 7/1999 | Park et al. | 702/76 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,236,731 | B1 | 5/2001 | Brennan et al. | 381/316 |
| 6,408,327 | B1 | 6/2002 | McClennon et al. | 709/204 |
| 6,434,191 | B1 | 8/2002 | Agrawal et al. | 375/227 |
| 6,539,357 | B1 | 3/2003 | Sinha | 704/270.1 |
| 6,614,936 | B1 | 9/2003 | Wu et al. | 382/238 |
| 6,658,117 | B2 * | 12/2003 | Hasebe | 381/61 |
| 6,763,115 | B1 | 7/2004 | Kobayashi | 381/309 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 7,116,787 | B2 | 10/2006 | Faller | 381/17 |
| 2002/0055796 | A1 | 5/2002 | Katayama et al. | 700/94 |
| 2003/0035553 | A1 | 2/2003 | Baumgarte et al. | 381/94.2 |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 | 11/2003 | Baumgarte et al. | 381/17 |
| 2004/0091118 | A1 | 5/2004 | Griesinger | 381/20 |
| 2005/0069143 | A1 * | 3/2005 | Budnikov et al. | 381/63 |
| 2005/0157883 | A1 | 7/2005 | Herre et al. | 381/17 |
| 2005/0226426 | A1 | 10/2005 | Oomen et al. | 381/23 |

FOREIGN PATENT DOCUMENTS

| | | | |
|---|---|---|---|
| EP | 1 479 071 | B1 | 1/2006 |
| JP | 07123008 | | 5/1995 |
| TW | 347623 | | 12/1998 |
| TW | 510144 | | 11/2002 |
| WO | WO 03/090207 | A1 | 10/2003 |
| WO | WO 03/094369 | A2 | 11/2003 |
| WO | WO 2004/008806 | A1 | 1/2004 |
| WO | WO 2004/049309 | A1 | 6/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"Advances in Parametric Coding for High-Quality Audio," by E.G.P. Schuijers et al., Proc. 1st IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118th Convention, May 28-31, 2005, Barcelona, Spain, pp. 1-13, XP009059973.

"From Joint Stereo to Spatial Audio Coding— Recent Progress and Standardization," by Jurgen Herre, Proc. of the 7th Int. Conference on Digital Audio Effects (DAFx' 04), Oct. 5-8, 2004, Naples, Italy, XP002367849.

"Parametric Coding of Spatial Audio," by Christof Faller, Proc. of the 7th Int. Conference on Digital Audio Effects (DAFx' 04), Oct. 5-8, 2004, Naples, Itlay, XP002367850.

"Binaural Cue Coding— Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions on Speech and Audio Processing, vol. II, No. 6, Nov. 2003, pp. 520-531.

"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.

"Binaural Cue Coding Applied to Stereo and Multi-Channel Audio Compression", by Christof Faller et al., Audio Engineering Society Convention Paper, 112th Convention, Munich, Germany, May 10-13, 2002, pp. 1-9.

"Advances in Parametric Coding for High-Quality Audio", by Erik Schuijers et al., Audio Engineerying Society Convention Paper 5852, 114th Convention, Amsterdam, The Netherlands, Mar. 22-25, 2003, pp. 1-11.

"Colorless Artificial Reverberation", by M.R. Schroeder et al., IRE Transactions on Audio, pp. 209-214, (Originally Published by: J. Audio Engrg. Soc., vol. 9, pp. 192-197, Jul. 1961).

"Efficient Representation of Spatial Audio Using Perceptual Parametrization",, by Christof Faller etl al., IEEE Workshop on Applications of Signal Processing to Audio and Acoustics 2001, Oct. 21-24, 2001, New Paltz, New York, pp. W2001-01 to W2001-4.

"3D Audio and Acoustic Environment Modeling" by William G. Gardner, HeadWize Technical Paper, Jan. 2001, pp. 1-11.

"Responding to One of Two Simultaneous Message", by Walter Spieth et al., The Journal of the Acoustical Society of America, vol. 26, No. 3, May 1954, pp. 391-396.

"A Speech Corpus for Multitalker Communications Research", by Robert S. Bolia, et al., J. Acoust. Soc., Am., vol. 107, No. 2, Feb. 2000, pp. 1065-1066.

"Synthesized Stereo Combined with Acoustic Echo Cancellation for Desktop Conferencing", by Jacob Benesty et al., Bell Labs Technical Journal, Jul.-Sep. 1998, pp. 148-158.

"The Role of Perceived Spatial Separation in the Unmasking of Speech", by Richard Freyman et al., J. Acoust. Soc., Am., vol. 106, No. 6, Dec. 1999, pp. 3578-3588.

"Text of ISO/IEC 14496-3:2002/PDAM 2 (Parametric coding for High Quality Audio)", by International Organisation for Standisation ISO/IEC JTC1/SC29/WG11 Coding of Moving Pictures and Audio, MPEG2002 N5381 Awaji Island, Dec. 2002, pp. 1-69.

"Binaural Cue Coding Applied to Stereo and Multi-Channel Audio Compression," by Christof Faller et al., Audio Engineering Society 112th Covention, Munich, Germany, vol. 112, No. 5574, May 10, 2002, pp. 1-9.

"MPEG Audio Layer II: A Generic Coding Standard For Two And Multichannel Sound For DVB, DAB and Computer Multimedia," by G. Stoll, International Broadcasting Convention, Sep. 14-18, 1995, Germany, XP006528918, pp. 136-144.

"Binaural Cue Coding: Rendering of Sources Mixed into a Mono Signal" by Christof Faller, Media Signal Processing Research, Agere Systems, Allentown, PA, USA, Mar. 2003, 2 pages.

"HILN- The MPEG-4 Parametric Audio Coding Tools" by Heiko Purnhagen and Nikolaus Meine, University of Hannover, Hannover, Germany, 2000, 4 pages.

"Parametric Audio Coding" by Bernd Edler and Heiko Purnhagen, University of Hannover, Hannover, Germany, 2000, pp. 1-4.

"Surround Sound Past, Present, and Future" by Joseph Hull; Dolby Laboratories Inc.; 1999; 8 pages.

* cited by examiner

LATE REVERBERATION-BASED SYNTHESIS OF AUDITORY SCENES

CROSS-REFERENCE TO RELATED APPLICATIONS

This application claims the benefit of the filing date of U.S. provisional application No. 60/544,287, filed on Feb. 12, 2004. The subject matter of this application is related to the subject matter of U.S. patent application Ser. No. 09/848,877, filed on May 4, 2001 as ("the '877 application"), U.S. patent application Ser. No. 10/045,458, filed on Nov. 7, 2001 as ("the '458 application"), and U.S. patent application Ser. No. 10/155,437, filed on May 24, 2002 as ("the '437 application"), the teachings of all three of which are incorporated herein by reference. See, also, C. Faller and F. Baumgarte, "Binaural Cue Coding Applied to Stereo and Multi-Channel Audio Compression," *Preprint* 112*th Conv. Aud. Eng. Soc.*, May, 2002, the teachings of which are also incorporated herein by reference.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-*D Sound for Virtual Reality and Multimedia,* Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

FIG. 2 shows a high-level block diagram of conventional auditory scene synthesizer 200, which converts a plurality of audio source signals (e.g., a plurality of mono signals) into the left and right audio signals of a single combined binaural signal, using a different set of spatial cues for each different audio source. The left audio signals are then combined (e.g., by simple addition) to generate the left audio signal for the resulting auditory scene, and similarly for the right.

One of the applications for auditory scene synthesis is in conferencing. Assume, for example, a desktop conference with multiple participants, each of whom is sitting in front of his or her own personal computer (PC) in a different city. In addition to a PC monitor, each participant's PC is equipped with (1) a microphone that generates a mono audio source signal corresponding to that participant's contribution to the audio portion of the conference and (2) a set of headphones for playing that audio portion. Displayed on each participant's PC monitor is the image of a conference table as viewed from the perspective of a person sitting at one end of the table. Displayed at different locations around the table are real-time video images of the other conference participants.

In a conventional mono conferencing system, a server combines the mono signals from all of the participants into a single combined mono signal that is transmitted back to each participant. In order to make more realistic the perception for each participant that he or she is sitting around an actual conference table in a room with the other participants, the server can implement an auditory scene synthesizer, such as synthesizer 200 of FIG. 2, that applies an appropriate set of spatial cues to the mono audio signal from each different participant and then combines the different left and right audio signals to generate left and right audio signals of a single combined binaural signal for the auditory scene. The left and right audio signals for this combined binaural signal are then transmitted to each participant. One of the problems with such conventional stereo conferencing systems relates to transmission bandwidth, since the server has to transmit a left audio signal and a right audio signal to each conference participant.

SUMMARY OF THE INVENTION

The '877 and '458 applications describe techniques for synthesizing auditory scenes that address the transmission bandwidth problem of the prior art. According to the '877 application, an auditory scene corresponding to multiple audio sources located at different positions relative to the listener is synthesized from a single combined (e.g., mono) audio signal using two or more different sets of auditory scene parameters (e.g., spatial cues such as an inter-channel level difference (ICLD) value, an inter-channel time delay (ICTD) value, and/or a head-related transfer function (HRTF)). As such, in the case of the PC-based conference described previously, a solution can be implemented in which each participant's PC receives only a single mono audio signal corresponding to a combination of the mono audio source signals from all of the participants (plus the different sets of auditory scene parameters).

The technique described in the '877 application is based on an assumption that, for those frequency sub-bands in which the energy of the source signal from a particular audio source dominates the energies of all other source signals in the mono audio signal, from the perspective of the perception by the listener, the mono audio signal can be treated as if it corresponded solely to that particular audio source. According to implementations of this technique, the different sets of auditory scene parameters (each corresponding to a particular audio source) are applied to different frequency sub-bands in the mono audio signal to synthesize an auditory scene.

The technique described in the '877 application generates an auditory scene from a mono audio signal and two or more different sets of auditory scene parameters. The '877 application describes how the mono audio signal and its corresponding sets of auditory scene parameters are generated. The technique for generating the mono audio signal and its corresponding sets of auditory scene parameters is referred to in this specification as binaural cue coding (BCC). The BCC technique is the same as the perceptual coding of spatial cues (PCSC) technique referred to in the '877 and '458 applications.

According to the '458 application, the BCC technique is applied to generate a combined (e.g., mono) audio signal in which the different sets of auditory scene parameters are embedded in the combined audio signal in such a way that the resulting BCC signal can be processed by either a BCC-based decoder or a conventional (i.e., legacy or non-BCC) receiver. When processed by a BCC-based decoder, the BCC-based decoder extracts the embedded auditory scene parameters and applies the auditory scene synthesis technique of the '877 application to generate a binaural (or higher) signal. The auditory scene parameters are embedded in the BCC signal in such a way as to be transparent to a conventional receiver, which processes the BCC signal as if it were a conventional (e.g., mono) audio signal. In this way, the technique described in the '458 application supports the BCC processing of the '877 application by BCC-based decoders, while providing backwards compatibility to enable BCC signals to be processed by conventional receivers in a conventional manner.

The BCC techniques described in the '877 and '458 applications effectively reduce transmission bandwidth requirements by converting, at a BCC encoder, a binaural input signal (e.g., left and right audio channels) into a single mono audio channel and a stream of binaural cue coding (BCC) parameters transmitted (either in-band or out-of-band) in parallel with the mono signal. For example, a mono signal can be transmitted with approximately 50-80% of the bit rate otherwise needed for a corresponding two-channel stereo signal. The additional bit rate for the BCC parameters is only a few kbits/sec (i.e., more than an order of magnitude less than an encoded audio channel). At the BCC decoder, left and right channels of a binaural signal are synthesized from the received mono signal and BCC parameters.

The coherence of a binaural signal is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space.

The BCC techniques of the '877 and '458 applications generate binaural signals in which the coherence between the left and right channels approaches the maximum possible value of 1. If the original binaural input signal has less than the maximum coherence, the BCC decoder will not recreate a stereo signal with the same coherence. This results in auditory image errors, mostly by generating too narrow images, which produces a too "dry" acoustic impression.

In particular, the left and right output channels will have a high coherence, since they are generated from the same mono signal by slowly-varying level modifications in auditory critical bands. A critical band model, which divides the auditory range into a discrete number of audio sub-bands, is used in psychoacoustics to explain the spectral integration of the auditory system. For headphone playback, the left and right output channels are the left and right ear input signals, respectively. If the ear signals have a high coherence, then the auditory objects contained in the signals will be perceived as very "localized" and they will have only a very small spread in the auditory spatial image. For loudspeaker playback, the loudspeaker signals only indirectly determine the ear signals, since cross-talk from the left loudspeaker to the right ear and from the right loudspeaker to the left ear has to be taken into account. Moreover, room reflections can also play a significant role for the perceived auditory image. However, for loudspeaker playback, the auditory image of highly coherent signals is very narrow and localized, similar to headphone playback.

According to the '437 application, the BCC techniques of the '877 and '458 applications are extended to include BCC parameters that are based on the coherence of the input audio signals. The coherence parameters are transmitted from the BCC encoder to a BCC decoder along with the other BCC parameters in parallel with the encoded mono audio signal. The BCC decoder applies the coherence parameters in combination with the other BCC parameters to synthesize an auditory scene (e.g., the left and right channels of a binaural signal) with auditory objects whose perceived widths more accurately match the widths of the auditory objects that generated the original audio signals input to the BCC encoder.

A problem related to the narrow image width of auditory objects generated by the BCC techniques of the '877 and '458 applications is the sensitivity to inaccurate estimates of the auditory spatial cues (i.e., the BCC parameters). Especially with headphone playback, auditory objects that should be at a stable position in space tend to move randomly. The perception of objects that unintentionally move around can be annoying and substantially degrade the perceived audio quality. This problem substantially if not completely disappears, when embodiments of the '437 application are applied.

The coherence-based technique of the '437 application tends to work better at relatively high frequencies than at relatively low frequencies. According to certain embodiments of the present invention, the coherence-based technique of the '437 application is replaced by a reverberation technique for one or more—and possibly all—frequency sub-bands. In one hybrid embodiment, the reverberation technique is implemented for low frequencies (e.g., frequency sub-bands less than a specified (e.g., empirically determined) threshold frequency), while the coherence-based technique of the '437 application is implemented for high frequencies (e.g., frequency sub-bands greater than the threshold frequency).

In one embodiment, the present invention is a method for synthesizing an auditory scene. At least one input channel is processed to generate two or more processed input signals, and the at least one input channel is filtered to generate two or more diffuse signals. The two or more diffuse signals are combined with the two or more processed input signals to generate a plurality of output channels for the auditory scene.

In another embodiment, the present invention is an apparatus for synthesizing an auditory scene. The apparatus includes a configuration of at least one time domain to frequency domain (TD-FD) converter and a plurality of filters, where the configuration is adapted to generate two or more processed FD input signals and two or more diffuse FD signals from at least one TD input channel. The apparatus also has (a) two or more combiners adapted to combine the two or more diffuse FD signals with the two or more processed FD input signals to generate a plurality of synthesized FD signals and (b) two or more frequency domain to time domain (FD-TD) converters adapted to convert the synthesized FD signals into a plurality of TD output channels for the auditory scene.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

BCC-Based Audio Processing

Figure 1:
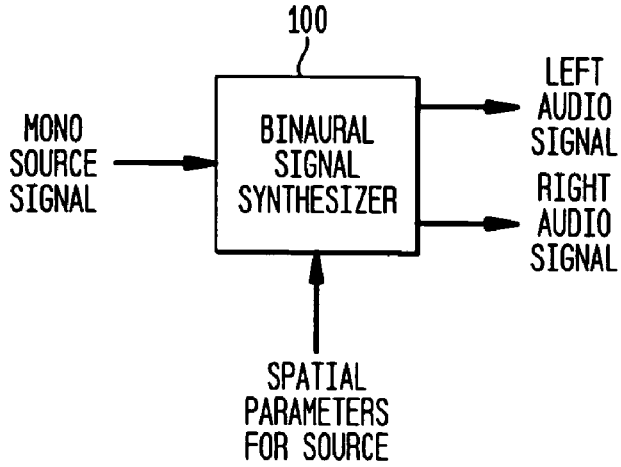
FIG. 1 (PRIOR ART)
FIG. 1 shows a high-level block diagram of conventional binaural signal synthesizer that converts a single audio source signal (e.g., a mono signal) into the left and right audio signals of a binaural signal.
Figure 2:
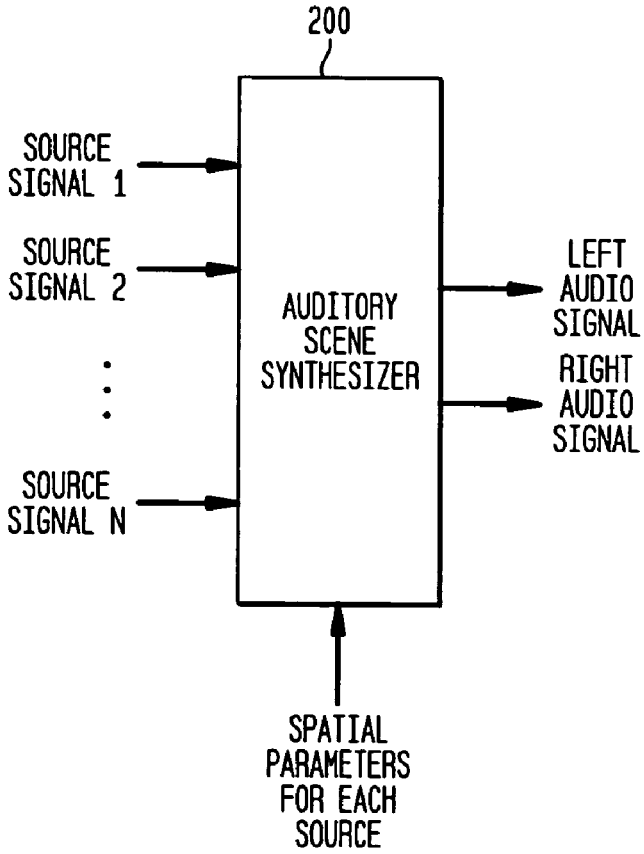
FIG. 2 (PRIOR ART)
FIG. 2 shows a high-level block diagram of conventional auditory scene synthesizer that converts a plurality of audio source signals (e.g., a plurality of mono signals) into the left and right audio signals of a single combined binaural signal.
Figure 3:
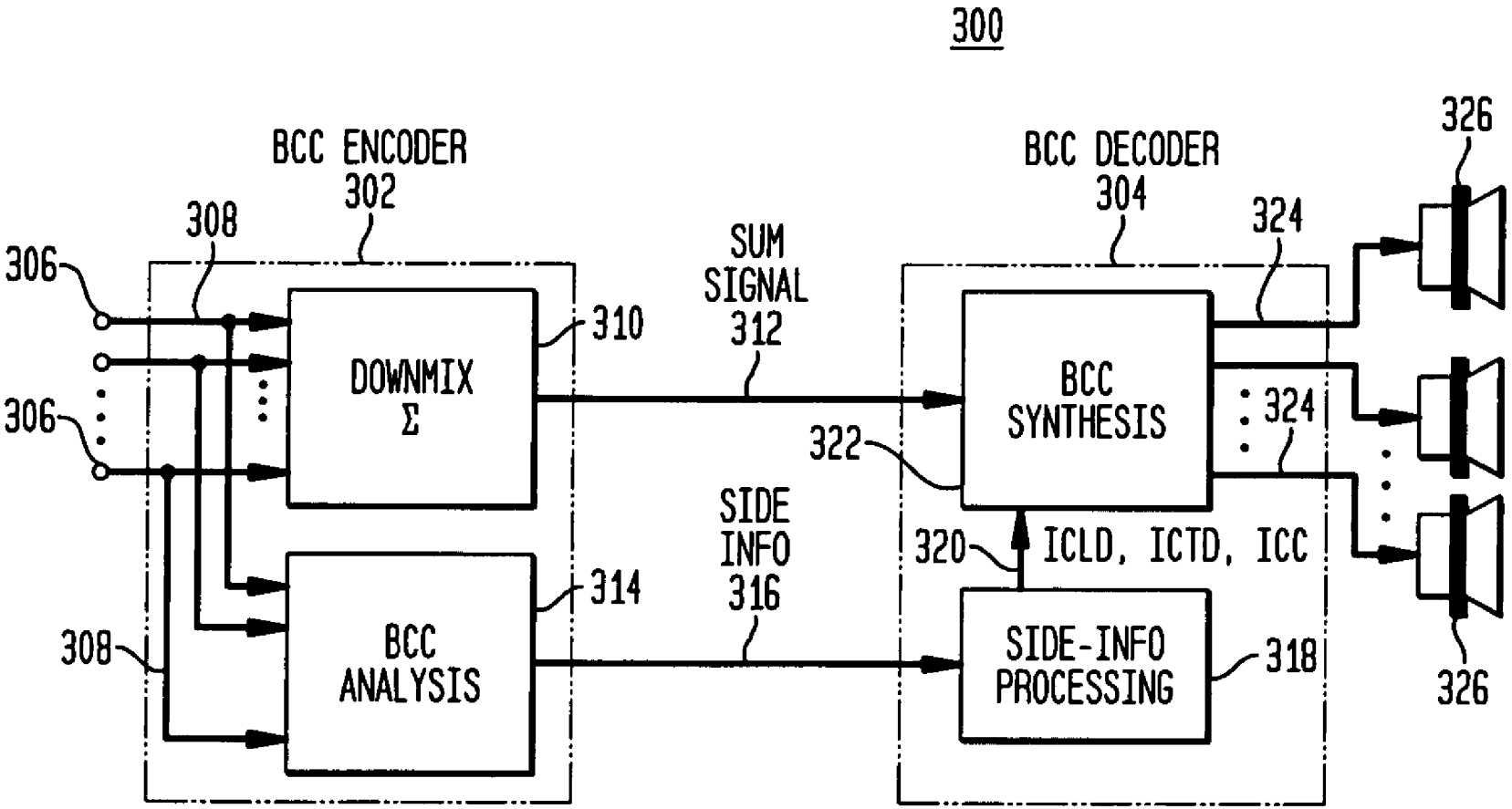
FIG. 3 shows a block diagram of an audio processing system that performs binaural cue coding (BCC)

FIG. 3 shows a block diagram of an audio processing system 300 that performs binaural cue coding (BCC). BCC system 300 has a BCC encoder 302 that receives C audio input channels 308, one from each of C different microphones 306, for example, distributed at different positions within a concert hall. BCC encoder 302 has a downmixer 310, which converts (e.g., averages) the C audio input channels into one or more, but fewer than C, combined channels 312. In addition, BCC encoder 302 has a BCC analyzer 314, which generates BCC cue code data stream 316 for the C input channels.

In one possible implementation, the BCC cue codes include inter-channel level difference (ICLD), inter-channel time difference (ICTD), and inter-channel correlation (ICC) data for each input channel. BCC analyzer 314 preferably performs band-based processing analogous to that described in the '877 and '458 applications to generate ICLD and ICTD data for each of one or more different frequency sub-bands of the audio input channels. In addition, BCC analyzer 314 preferably generates coherence measures as the ICC data for each frequency sub-band. These coherence measures are described in greater detail in the next section of this specification.

BCC encoder 302 transmits the one or more combined channels 312 and the BCC cue code data stream 316 (e.g., as either in-band or out-of-band side information with respect to the combined channels) to a BCC decoder 304 of BCC system 300. BCC decoder 304 has a side-information processor 318, which processes data stream 316 to recover the BCC cue codes 320 (e.g., ICLD, ICTD, and ICC data). BCC decoder 304 also has a BCC synthesizer 322, which uses the recovered BCC cue codes 320 to synthesize C audio output channels 324 from the one or more combined channels 312 for rendering by C loudspeakers 326, respectively.

The definition of transmission of data from BCC encoder 302 to BCC decoder 304 will depend on the particular application of audio processing system 300. For example, in some applications, such as live broadcasts of music concerts, transmission may involve real-time transmission of the data for immediate playback at a remote location. In other applications, "transmission" may involve storage of the data onto CDs or other suitable storage media for subsequent (i.e., non-real-time) playback. Of course, other applications may also be possible.

In one possible application of audio processing system 300, BCC encoder 302 converts the six audio input channels of conventional 5.1 surround sound (i.e., five regular audio channels+one low-frequency effects (LFE) channel, also known as the subwoofer channel) into a single combined channel 312 and corresponding BCC cue codes 316, and BCC decoder 304 generates synthesized 5.1 surround sound (i.e., five synthesized regular audio channels+one synthesized LFE channel) from the single combined channel 312 and BCC cue codes 316. Many other applications, including 7.1 surround sound or 10.2 surround sound, are also possible.

Furthermore, although the C input channels can be downmixed to a single combined channel 312, in alternative implementations, the C input channels can be downmixed to two or more different combined channels, depending on the particular audio processing application. In some applications, when downmixing generates two combined channels, the combined channel data can be transmitted using conventional stereo audio transmission mechanisms. This, in turn, can provide backwards compatibility, where the two BCC combined channels are played back using conventional (i.e., non-BCC-based) stereo decoders. Analogous backwards compatibility can be provided for a mono decoder when a single BCC combined channel is generated.

Although BCC system 300 can have the same number of audio input channels as audio output channels, in alternative embodiments, the number of input channels could be either greater than or less than the number of output channels, depending on the particular application.

Depending on the particular implementation, the various signals received and generated by both BCC encoder 302 and BCC decoder 304 of FIG. 3 may be any suitable combination of analog and/or digital signals, including all analog or all digital. Although not shown in FIG. 3, those skilled in the art will appreciate that the one or more combined channels 312 and the BCC cue code data stream 316 may be further encoded by BCC encoder 302 and correspondingly decoded by BCC decoder 304, for example, based on some appropriate compression scheme (e.g., ADPCM) to further reduce the size of the transmitted data.

Coherence Estimation

Figure 4:
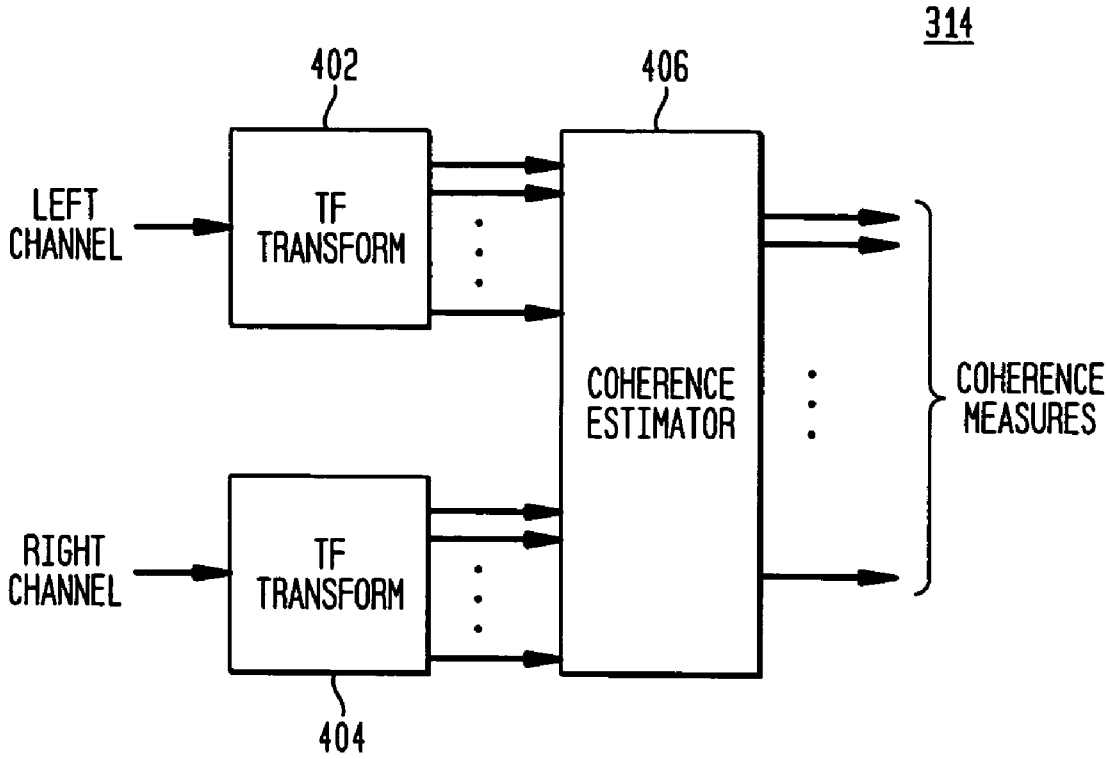
FIG. 4 shows a block diagram of that portion of the processing of the BCC analyzer of FIG. 3 corresponding to the generation of coherence measures, according to one embodiment of the '437 application.

FIG. 4 shows a block diagram of that portion of the processing of BCC analyzer 314 of FIG. 3 corresponding to the generation of coherence measures, according to one embodiment of the '437 application. As shown in FIG. 4, BCC analyzer 314 comprises two time-frequency (TF) transform blocks 402 and 404, which apply a suitable transform, such as a short-time discrete Fourier transform (DFT) of length 1024, to convert left and right input audio channels L and R, respectively, from the time domain into the frequency domain. Each transform block generates a number of outputs corresponding to different frequency sub-bands of the input audio channels. Coherence estimator 406 characterizes the coherence of each of the different considered critical bands (denoted sub-bands in the following). Those skilled in the art will appreciate that, in preferred DFT-based implementations, the number of DFT coefficients considered as one critical band varies from critical band to critical band with lower-frequency critical bands typically having fewer coefficients than higher-frequency critical bands.

In one implementation, the coherence of each DFT coefficient is estimated. The real and imaginary parts of the spectral component $K_L$ of the left channel DFT spectrum may be denoted $Re\{K_L\}$ and $Im\{K_L\}$, respectively, and analogously for the right channel. In that case, the power estimates $P_{LL}$ and $P_{RR}$ for the left and right channels may be represented by Equations (1) and (2), respectively, as follows:

$$P_{LL}=(1-\alpha)P_{LL}+\alpha(Re^2\{K_L\}+Im^2\{K_L\}) \quad (1)$$

$$P_{RR}=(1-\alpha)P_{RR}+\alpha(Re^2\{K_R\}+Im^2\{K_R\}) \quad (2)$$

The real and imaginary cross terms $P_{LR,Re}$ and $P_{LR,Im}$ are given by Equations (3) and (4), respectively, as follows:

$$P_{LR,Re}=(1-\alpha)P_{LR}+\alpha(Re\{K_L\}Re\{K_R\}-Im\{K_L\}Im\{K_R\}) \quad (3)$$

$$P_{LR,Im}=(1-\alpha)P_{LR}+\alpha(Re\{K_L\}Im\{K_R\}+Im\{K_L\}Re\{K_R\}) \quad (4)$$

The factor $\alpha$ determines the estimation window duration and can be chosen as $\alpha=0.1$ for an audio sampling rate of 32 kHz and a frame shift of 512 samples. As derived from Equations (1)-(4), the coherence estimate $\gamma$ for a sub-band is given by Equation (5) as follows:

$$\gamma\sqrt{(P_{LR,Re}^2+P_{LR,Im}^2)/(P_{LL}P_{RR})} \quad (5)$$

As mentioned previously, coherence estimator 406 averages the coefficient coherence estimates $\gamma$ over each critical band. For that averaging, a weighting function is preferably applied to the sub-band coherence estimates before averaging. The weighting can be made proportional to the power estimates given by Equations (1) and (2). For one critical band p, which contains the spectral components n1, n1+1, . . . , n2, the averaged weighted coherence $\bar{\gamma}_p$ may be calculated using Equation (6) as follows:

$$\bar{\gamma}_p=\frac{\sum_{n=n1}^{n2}\{(P_{LL}(n)+P_{RR}(n))\gamma(n)\}}{\sum_{n=n1}^{n2}\{(P_{LL}(n)+P_{RR}(n))\}}, \quad (6)$$

where $P_{LL}(n)$, $P_{RR}(n)$, and $\gamma(n)$ are the left channel power, right channel power, and coherence estimates for spectral coefficient n as given by Equations (1), (2), and (6), respectively. Note that Equations (1)-(6) are all per individual spectral coefficients n.

In one possible implementation of BCC encoder 302 of FIG. 3, the averaged weighted coherence estimates $\bar{\gamma}_p$ for the different critical bands are generated by BCC analyzer 314 for inclusion in the BCC parameter stream transmitted to BCC decoder 304.

Coherence-Based Audio Synthesis

Figure 5:
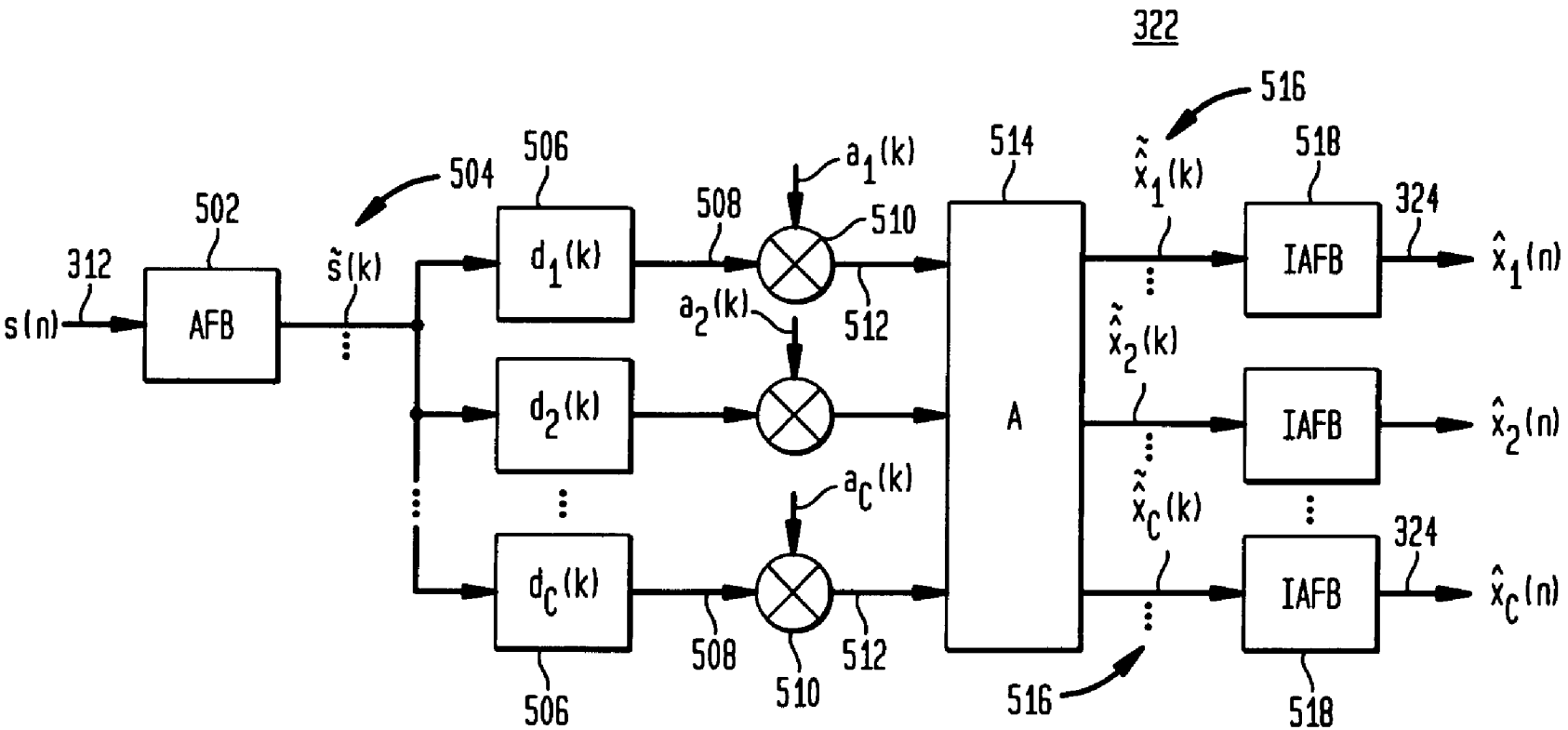
FIG. 5 shows a block diagram of the audio processing performed by one embodiment of the BCC synthesizer of FIG. 3 to convert a single combined channel into two or more synthesized audio output channels using coherence-based audio synthesis.

FIG. 5 shows a block diagram of the audio processing performed by one embodiment of BCC synthesizer 322 of FIG. 3 to convert a single combined channel 312 (s(n)) into C synthesized audio output channels 324 ($\hat{x}_1(n)$, $\hat{x}_2(n)$, . . . , $\hat{x}_C(n)$) using coherence-based audio synthesis. In particular, BCC synthesizer 322 has an auditory filter bank (AFB) block 502, which performs a time-frequency (TF) transform (e.g., a fast Fourier transform (FFT)) to convert time-domain combined channel 312 into C copies of a corresponding frequency-domain signal 504 ($\tilde{s}(k)$).

Each copy of the frequency-domain signal 504 is delayed at a corresponding delay block 506 based on delay values ($d_i(k)$) derived from the corresponding inter-channel time difference (ICTD) data recovered by side-information processor 318 of FIG. 3. Each resulting delayed signal 508 is scaled by a corresponding multiplier 510 based on scale (i.e., gain) factors ($\alpha_i(k)$) derived from the corresponding inter-channel level difference (ICLD) data recovered by side-information processor 318.

The resulting scaled signals 512 are applied to coherence processor 514, which applies coherence processing based on ICC coherence data recovered by side-information processor 318 to generate C synthesized frequency-domain signals 516 ($\hat{x}_1(k)$, $\hat{x}_2(k)$, . . . , $\hat{x}_3(k)$), one for each output channel. Each synthesized frequency-domain signal 516 is then applied to a corresponding inverse AFB (IAFB) block 518 to generate a different time-domain output channel 324 ($\hat{x}_i(n)$).

In a preferred implementation, the processing of each delay block 506, each multiplier 510, and coherence processor 514 is band-based, where potentially different delay values, scale factors, and coherence measures are applied to each different frequency sub-band of each different copy of the frequency-domain signals. Given the estimated coherence for each sub-band, the magnitude is varied as a function of frequency within the sub-band. Another possibility is to vary the phase as a function of frequency in the partition as a function of the estimated coherence. In a preferred implementation, the phase is varied such as to impose different delays or group delays as a function of frequency within the sub-band. Also, preferably the magnitude and/or delay (or group delay) variations are carried out such that, in each critical band, the mean of the modification is zero. As a result, ICLD and ICTD within the sub-band are not changed by the coherence synthesis.

In preferred implementations, the amplitude g (or variance) of the introduced magnitude or phase variation is controlled based on the estimated coherence of the left and right channels. For a smaller coherence, the gain g should be properly mapped as a suitable function $f(\gamma)$ of the coherence $\gamma$. In general, if the coherence is large (e.g., approaching the maximum possible value of +1), then the object in the input auditory scene is narrow. In that case, the gain g should be small (e.g., approaching the minimum possible value of 0) so that there is effectively no magnitude or phase modification within the sub-band. On the other hand, if the coherence is small (e.g., approaching the minimum possible value of 0), then the object in the input auditory scene is wide. In that case, the gain g should be large, such that there is significant magnitude and/or phase modification resulting in low coherence between the modified sub-band signals.

A suitable mapping function $f(\gamma)$ for the amplitude g for a particular critical band is given by Equation (7) as follows:

$$g=5(1-\bar{\gamma}) \tag{7}$$

where $\bar{\gamma}$ is the estimated coherence for the corresponding critical band that is transmitted to BCC decoder 304 of FIG. 3 as part of the stream of BCC parameters. According to this linear mapping function, the gain g is 0 when the estimated coherence $\bar{\gamma}$ is 1, and g=5, when $\bar{\gamma}$=0. In alternative embodiments, the gain g may be a non-linear function of coherence.

Although coherence-based audio synthesis has been described in the context of modifying the weighting factors $w_L$ and $w_R$ based on a pseudo-random sequence, the technique is not so limited. In general, coherence-based audio synthesis applies to any modification of perceptual spatial cues between sub-bands of a larger (e.g., critical) band. The modification function is not limited to random sequences. For example, the modification function could be based on a sinusoidal function, where the ICLD (of Equation (9)) is varied in a sinusoidal way as a function of frequency within the sub-band. In some implementations, the period of the sine wave varies from critical band to critical band as a function of the width of the corresponding critical band (e.g., with one or more full periods of the corresponding sine wave within each critical band). In other implementations, the period of the sine wave is constant over the entire frequency range. In both of these implementations, the sinusoidal modification function is preferably contiguous between critical bands.

Another example of a modification function is a sawtooth or triangular function that ramps up and down linearly between a positive maximum value and a corresponding negative minimum value. Here, too, depending on the implementation, the period of the modification function may vary from critical band to critical band or be constant across the entire frequency range, but, in any case, is preferably contiguous between critical bands.

Although coherence-based audio synthesis has been described in the context of random, sinusoidal, and triangular functions, other functions that modify the weighting factors within each critical band are also possible. Like the sinusoidal and triangular functions, these other modification functions may be, but do not have to be, contiguous between critical bands.

According to the embodiments of coherence-based audio synthesis described above, spatial rendering capability is achieved by introducing modified level differences between sub-bands within critical bands of the audio signal. Alternatively or in addition, coherence-based audio synthesis can be applied to modify time differences as valid perceptual spatial cues. In particular, a technique to create a wider spatial image of an auditory object similar to that described above for level differences can be applied to time differences, as follows.

As defined in the '877 and '458 applications, the time difference in sub-band s between two audio channels is denoted $\tau_s$. According to certain implementations of coherence-based audio synthesis, a delay offset $d_s$ and a gain factor $g_c$ can be introduced to generate a modified time difference $\tau_s'$ for sub-band s according to Equation (8) as follows.

$$\tau_s'=g_c d_s+\tau_s \tag{8}$$

The delay offset $d_s$ is preferably constant over time for each sub-band, but varies between sub-bands and can be chosen as a zero-mean random sequence or a smoother function that preferably has a mean value of zero in each critical band. As with the gain factor g in Equation (9), the same gain factor $g_c$ is applied to all sub-bands n that fall inside each critical band c, but the gain factor can vary from critical band to critical band. The gain factor $g_c$ is derived from the coherence estimate using a mapping function that is preferably proportional to linear mapping function of Equation (7). As such, $g_c$=ag, where the value of constant a is determined by experimental tuning. In alternative embodiments, the gain $g_c$ may be a non-linear function of coherence. BCC synthesizer 322 applies the modified time differences $\tau_s'$ instead of the original time differences $\tau_s$. To increase the image width of an auditory object, both level-difference and time-difference modifications can be applied.

Although coherence-based processing has been described in the context of generating the left and right channels of a stereo audio scene, the techniques can be extended to any arbitrary number of synthesized output channels.

Reverberation-Based Audio Synthesis

Definitions, Notation, and Variables

The following measures are used for ICLD, ICTD, and ICC for corresponding frequency-domain input sub-band signals $\tilde{x}_1(k)$ and $\tilde{x}_2(k)$ of two audio channels with time index k:

ICLD (dB):

$$\Delta L_{12}(k) = 10\log_{10}\left(\frac{p_{\tilde{x}_2}(k)}{p_{\tilde{x}_1}(k)}\right), \tag{9}$$

where $p_{x_1}(k)$ and $p_{x_2}(k)$ are short-time estimates of the power of the signals $\tilde{x}_1(k)$ and $\tilde{x}_2(k)$, respectively.

ICTD (samples):

$$\tau_{12}(k) = \arg\max_d \{\Phi_{12}(d, k)\}, \tag{10}$$

with a short-time estimate of the normalized cross-correlation function $$\Phi_{12}(d, k) = \frac{p_{\tilde{x}_1\tilde{x}_2}(d, k)}{\sqrt{p_{\tilde{x}_1}(k - d_1)\, p_{\tilde{x}_2}(k - d_2)}} \tag{11}$$

where $$d_1 = \max\{-d, 0\} \quad d_2 = \max\{d, 0\}, \tag{12}$$

and $p_{x_1x_2}(d, k)$ is a short-time estimate of the mean of $\tilde{x}_1(k-d_1)\tilde{x}_2(k-d_2)$

ICC:

$$c_{12}(k) = \max_d |\Phi_{12}(d, k)|. \tag{13}$$

Note that the absolute value of the normalized cross-correlation is considered and $c_{12}(k)$ has a range of [0,1]. There is no need to consider negative values, since ICTD contains the phase information represented by the sign of $c_{12}(k)$.

Figure 6A:
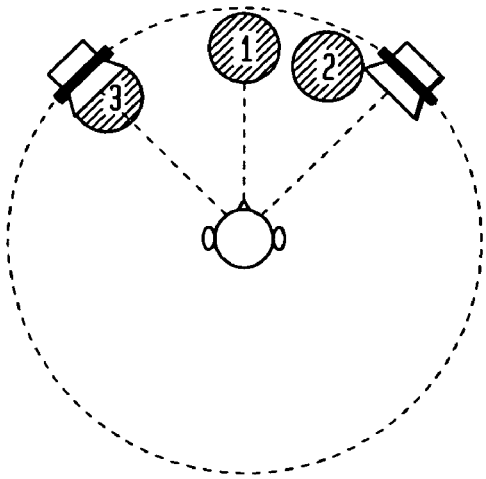
FIGS. 6(A)-(E) illustrate the perception of signals with different cue codes.
Figure 6B:
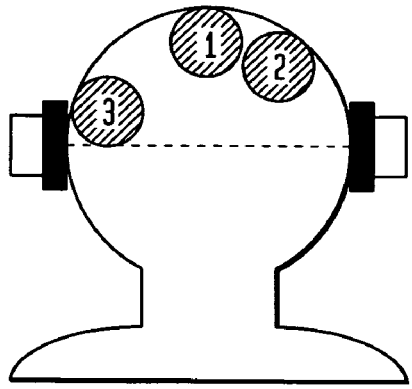
Figure 6C:
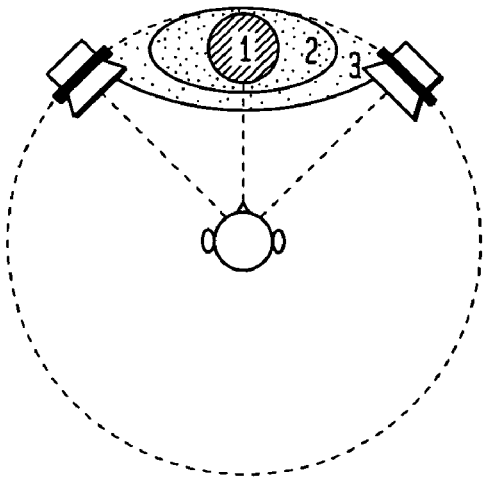
Figure 6D:
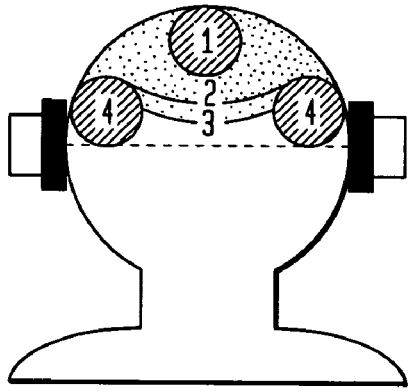
Figure 6E:
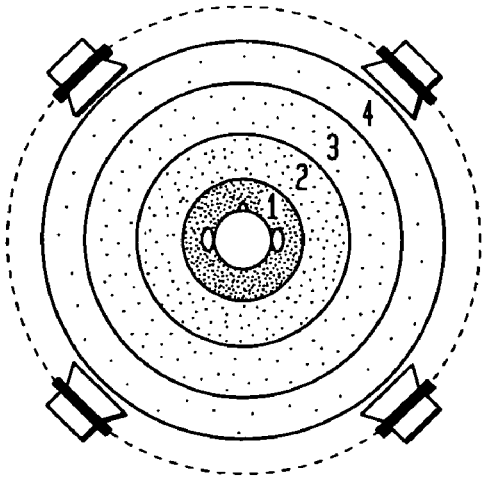

The following notation and variables are used in this specification:

* convolution operator
i audio channel index
k time index of sub-band signals (also time index of STFT spectra)
C number of encoder input channels, also number of decoder output channels
$x_i(n)$ time-domain encoder input audio channel (e.g., one of channels 308 of FIG. 3)
$\tilde{x}_i(k)$ one frequency-domain sub-band signal of $x_i(n)$ (e.g., one of the outputs from TF transform 402 or 404 of FIG. 4)
s(n) transmitted time-domain combined channel (e.g., sum channel 312 of FIG. 3)
$\tilde{s}(k)$ one frequency-domain sub-band signal of s(n) (e.g., signal 704 of FIG. 7)
$s_i(n)$ de-correlated time-domain combined channel (e.g., a filtered channel 722 of FIG. 7)
$\tilde{s}_i(k)$ one frequency-domain sub-band signal of $s_i(n)$ (e.g., a corresponding signal 726 of FIG. 7)
$\hat{x}_i(n)$ time-domain decoder output audio channel (e.g., a signal 324 of FIG. 3)
$\tilde{\hat{x}}_i(k)$ one frequency-domain sub-band signal of $\hat{x}_i(n)$ (e.g., a corresponding signal 716 of FIG. 7)
$p_{x_i}(k)$ short-time estimate of power of $\tilde{x}_i(k)$
$h_i(n)$ late reverberation (LR) filter for output channel i (e.g., an LR filter 720 of FIG. 7)
M length of LR filters $h_i(n)$
ICLD inter-channel level difference
ICTD inter-channel time difference
ICC inter-channel correlation
$\Delta L_{1i}(k)$ ICLD between channel 1 and channel i
$\tau_{1i}(k)$ ICTD between channel 1 and channel i
$c_{1i}(k)$ ICC between channel 1 and channel i
STFT short-time Fourier transform
$X_k(j\omega)$ STFT spectrum of a signal Perception of ICLD, ICTD, and ICC FIGS. 6(A)-(E) illustrate the perception of signals with different cue codes. In particular, FIG. 6(A) shows how the ICLD and ICTD between a pair of loudspeaker signals determine the perceived angle of an auditory event. FIG. 6(B) shows how the ICLD and ICTD between a pair of headphone signals determine the location of an auditory event that appears in the frontal section of the upper head. FIG. 6(C) shows how the extent of the auditory event increases (from region 1 to region 3) as the ICC between the loudspeaker signals decreases. FIG. 6(D) shows how the extent of the auditory object increases (from region 1 to region 3) as the ICC between left and right headphone signals decreases, until two distinct auditory events appear at the sides (region 4). FIG. 6(E) shows how, for multi-loudspeaker playback, the auditory event surrounding the listener increases in extent (from region 1 to region 4) as the ICC between the signals decreases.

Coherent Signals (ICC=1)

FIGS. 6(A) and 6(B) illustrate perceived auditory events for different ICLD and ICTD values for coherent loudspeaker and headphone signals. Amplitude panning is the most commonly used technique for rendering audio signals for loudspeaker and headphone playback. When left and right loudspeaker or headphone signals are coherent (i.e., ICC=1), have the same level (i.e., ICLD=0), and have no delay (i.e., ICTD=0), an auditory event appears in the center, as illustrated by regions 1 in FIGS. 6(A) and 6(B). Note that auditory events appear, for the loudspeaker playback of FIG. 6(A), between the two loudspeakers and, for the headphone playback of FIG. 6(B), in the frontal section of the upper half of the head.

By increasing the level on one side, e.g., right, the auditory event moves to that side, as illustrated by regions 2 in FIGS. 6(A) and 6(B). In the extreme case, e.g., when only the signal on the left is active, the auditory event appears at the left side, as illustrated by regions 3 in FIGS. 6(A) and 6(B). ICTD can similarly be used to control the position of the auditory event. For headphone playback, ICTD can be applied for this purpose. However, ICTD is preferably not used for loudspeaker playback for several reasons. ICTD values are most effective in free-field when the listener is exactly in the sweet spot. In enclosed environments, due the reflections, the ICTD (with a small range, e.g., ±1 ms) will have very little impact on the perceived direction of the auditory event.

Partially Coherent Signals (ICC<1)

When coherent (ICC=1) wideband sounds are simultaneously emitted by a pair of loudspeakers, a relatively compact auditory event is perceived. When the ICC is reduced between these signals, the extent of the auditory event increases, as illustrated in FIG. 6(C) from region 1 to region 3. For headphone playback, a similar trend can be observed, as illustrated in FIG. 6(D). When two identical signals (ICC=1) are emitted by the headphones, a relatively compact auditory event is perceived, as in region 1. The extent of the auditory event increases, as in regions 2 and 3, as the ICC between the headphone signals decreases, until two distinct auditory events are perceived at the sides, as in region 4.

In general, ICLD and ICTD determine the location of the perceived auditory event, and ICC determines the extent or diffuseness of the auditory event. Additionally, there are listening situations, when a listener not only perceives auditory events at a distance, but perceives to be surrounded by diffuse sound. This phenomenon is called listener envelopment. Such a situation occurs for example in a concert hall, where late reverberation arrives at the listener's ears from all directions. A similar experience can be evoked by emitting independent noise signals from loudspeakers distributed all around a listener, as illustrated in FIG. 6(E). In this scenario, there is a relation between ICC and the extent of the auditory event surrounding the listener, as in regions 1 to 4.

The perceptions described above can be produced by mixing a number of de-correlated audio channels with low ICC. The following sections describe reverberation-based techniques for producing such effects.

Generating Diffuse Sound from a Single Combined Channel

As mentioned before, a concert hall is one typical scenario where a listener perceives a sound as diffuse. During late reverberation, sound arrives at the ears from random angles with random strengths, such that the correlation between the two ear input signals is low. This gives a motivation for generating a number of de-correlated audio channels by filtering a given combined audio channel s(n) with filters modeling late reverberation. The resulting filtered channels are also referred to as "diffuse channels" in this specification.

C diffuse channels $s_i(n)$, $(1 \leqq i \leqq C)$, are obtained by Equation (14) as follows:

$$s_i(n)=h_i(n)*s(n), \tag{14}$$

where * denotes convolution, and $h_i(n)$ are the filters modeling late reverberation. Late reverberation can be modeled by Equation (15) as follows:

$$h_i(n) = \begin{cases} n_i(n)\left(1 - \frac{1}{f_s T}\right)^n, & 0 \le n < M \\ 0, & \text{otherwise} \end{cases}, \tag{15}$$

where $n_i(n)$ $(1 \leqq i \leqq C)$ are independent stationary white Gaussian noise signals, T is the time constant in seconds of the exponential decay of the impulse response in seconds, $f_s$ is the sampling frequency, and M is the length of the impulse response in samples. An exponential decay is chosen, because the strength of late reverberation typically decays exponentially in time.

The reverberation time of many concert halls is in the range of 1.5 to 3.5 seconds. In order for the diffuse audio channels to be independent enough for generating diffuseness of concert hall recordings, T is chosen such that the reverberation times of $h_i(n)$ are in the same range. This is the case for T=0.4 seconds (resulting in a reverberation time of about 2.8 seconds).

By computing each headphone or loudspeaker signal channel as a weighted sum of s(n) and $s_i(n)$, $(1 \leqq i \leqq C)$, signals with desired diffuseness can be generated (with maximum diffuseness similar to a concert hall when only $s_i(n)$ are used). BCC synthesis preferably applies such processing in each sub-band separately, as is shown in the next section.

Exemplary Reverberation-Based Audio Synthesizer

Figure 7:
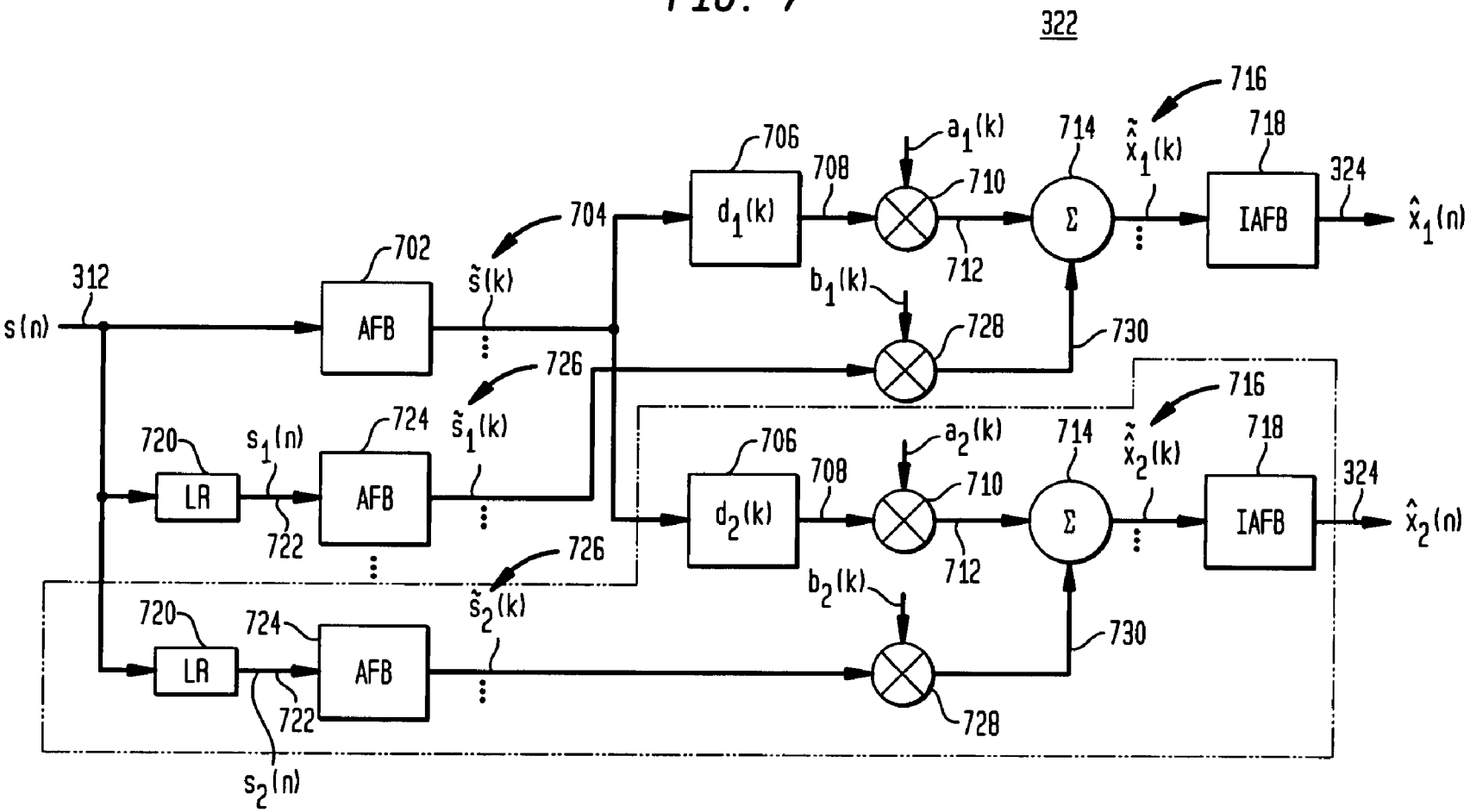
FIG. 7 shows a block diagram of the audio processing performed by the BCC synthesizer of FIG. 3 to convert a single combined channel into (at least) two synthesized audio output channels using reverberation-based audio synthesis, according to one embodiment of the present invention.

FIG. 7 shows a block diagram of the audio processing performed by BCC synthesizer 322 of FIG. 3 to convert a single combined channel 312 (s(n)) into (at least) two synthesized audio output channels 324 ($\hat{x}_1(n)$, $\hat{x}_2(n)$, . . . ) using reverberation-based audio synthesis, according to one embodiment of the present invention.

As shown in FIG. 7 and similar to processing in BCC synthesizer 322 of FIG. 5, AFB block 702 converts time-domain combined channel 312 into two copies of a corresponding frequency-domain signal 704 ($\tilde{s}(k)$). Each copy of the frequency-domain signal 704 is delayed at a corresponding delay block 706 based on delay values ($d_i(k)$) derived from the corresponding inter-channel time difference (ICTD) data recovered by side-information processor 318 of FIG. 3. Each resulting delayed signal 708 is scaled by a corresponding multiplier 710 based on scale factors ($a_i(k)$) derived from cue code data recovered by side-information processor 318. The derivation of these scale factors is described in further detail below. The resulting scaled, delayed signals 712 are applied to summation nodes 714.

In addition to being applied to AFB block 702, copies of combined channel 312 are also applied to late reverberation (LR) processors 720. In some implementations, the LR processors generate a signal similar to the late reverberation that would be evoked in a concert hall if the combined channel 312 were played back in that concert hall. Moreover, the LR processors can be used to generate late reverberation corresponding to different positions in the concert hall, such that their output signals are de-correlated. In that case, combined channel 312 and the diffuse LR output channels 722 ($s_1(n)$, $s_2(n)$) would have a high degree of independence (i.e., ICC values close to zero).

The diffuse LR channels 722 may be generated by filtering the combined signal 312 as described in the previous section using Equations (14) and (15). Alternatively, the LR processors can be implemented based on any other suitable reverberation technique, such as those described in M. R. Schroeder, "Natural sounding artificial reverberation," *J. Aud. Eng. Soc.*, vol. 10, no. 3, pp. 219-223, 1962, and W. G. Gardner, *Applications of Digital Signal Processing to Audio and Acoustics*, Kluwer Academic Publishing, Norwell, Mass., USA, 1998, the teachings of both of which are incorporated herein by reference. In general, preferred LR filters are those having a substantially random frequency response with a substantially flat spectral envelope.

The diffuse LR channels 722 are applied to AFB blocks 724, which convert the time-domain LR channels 722 into frequency-domain LR signals 726 ($\tilde{s}_1(k)$, $\tilde{s}_2(k)$). AFB blocks 702 and 724 are preferably invertible filter banks with sub-bands having bandwidths equal or proportional to the critical bandwidths of the auditory system. Each sub-band signal for the input signals s(n), $s_1(n)$, and $s_2(n)$ is denoted $\tilde{s}(k)$, $\tilde{s}_1(k)$, or $\tilde{s}_2(k)$, respectively. A different time index k is used for the decomposed signals instead of the input channel time index n, since the sub-band signals are usually represented with a lower sampling frequency than the original input channels.

Multipliers 728 multiply the frequency-domain LR signals 726 by scale factors ($b_i(k)$) derived from cue code data recovered by side-information processor 318. The derivation of these scale factors is described in further detail below. The resulting scaled LR signals 730 are applied to summation nodes 714.

Summation nodes 714 add scaled LR signals 730 from multipliers 728 to the corresponding scaled, delayed signals 712 from multipliers 710 to generate frequency-domain signals 716

$$(\tilde{\tilde{x}}_1(k), \tilde{\tilde{x}}_2(k))$$

for the different output channels. The sub-band signals 716 generated at summation nodes 714 are given by Equation (16) as follows:

$$\begin{aligned}\tilde{\tilde{x}}_1(k) &= a_1\tilde{s}(k-d_1) + b_1\tilde{s}_1(k)\\ \tilde{\tilde{x}}_2(k) &= a_2\tilde{s}(k-d_2) + b_2\tilde{s}_2(k)\end{aligned}, \tag{16}$$

where the scale factors $(a_1,a_2,b_1,b_2)$ and delays $(d_1,d_2)$ are determined as functions of the desired ICLD $\Delta L_{12}(k)$, ICTD $\tau_{12}(k)$, and ICC $c_{12}(k)$. (The time indices of the scale factors and delays are omitted for a simpler notation.). The signals $$\tilde{\tilde{x}}_1(k), \tilde{\tilde{x}}_2(k)$$

are generated for all sub-bands. Although the embodiment of FIG. 7 relies on summation nodes to combine the scaled LR signals with the corresponding scaled, delayed signals, in alternative embodiments, combiners other than summation nodes may be used to combine the signals. Examples of alternative combiners include those that perform weighted summation, summation of magnitudes, or selection of maximum values.

The ICTD $\tau_{12}(k)$ is synthesized by imposing different delays $(d_1,d_2)$ on $\tilde{s}(k)$. These delays are computed by Equation (10) with $d=\tau_{12}(n)$. In order for the output sub-band signals to have an ICLD equal to $\Delta L_{12}(k)$ of Equation (9), the scale factors $(a_1,a_2,b_1,b_2)$ should satisfy Equation (17) as follows:

$$\frac{a_1^2 p_{\tilde{s}}(k) + b_1^2 p_{\tilde{s}_1}(k)}{a_2^2 p_{\tilde{s}}(k) + b_2^2 p_{\tilde{s}_2}(k)} = 10^{\frac{\Delta L_{12}(k)}{10}}, \tag{17}$$

where $p_s(k)$, $p_{s_1}(k)$, and $p_{s_2}(k)$ are the short-time power estimates of the sub-band signals $\tilde{s}(k)$, $\tilde{s}_1(k)$, and $\tilde{s}_2(k)$, respectively.

For the output sub-band signals to have the ICC $c_{12}(k)$ of Equation (13), the scale factors $(a_1,a_2,b_1,b_2)$ should satisfy Equation (18) as follows:

$$\frac{(a_1^2 + a_2^2)p_{\tilde{s}}(k)}{(a_1^2 p_{\tilde{s}}(k) + b_1^2 p_{\tilde{s}_1}(k))(a_2^2 p_{\tilde{s}}(k) + b_2^2 p_{\tilde{s}_2}(k))} = c_{12}(k), \tag{18}$$

assuming that $\tilde{s}(k)$, $\tilde{s}_1(k)$, and $\tilde{s}_2(k)$ are independent.

Each IAFB block 718 converts a set of frequency-domain signals 716 into a time-domain channel 324 for one of the output channels. Since each LR processor 720 can be used to model late reverberation emanating from different directions in a concert hall, different late reverberation can be modeled for each different loudspeaker 326 of audio processing system 300 of FIG. 3.

BCC synthesis usually normalizes its output signals, such that the sum of the powers of all output channels is equal to the power of the input combined signal. This yields another equation for the gain factors:

$$(a_1^2+a_1^2)p_s(k)+b_1^2 p_{s_1}(k)+b_2^2 p_{s_2}(k)=p_s(k). \tag{19}$$

Since there are four gain factors and three equations, there is still one degree of freedom in the choice of the gain factors. Thus, an additional condition can be formulated as:

$$b_1^2 p_{s_1}(k)=b_2^2 p_{s_2}(k). \tag{20}$$

Equation (20) implies that the amount of diffuse sound is always the same in the two channels. There are several motivations for doing this. First, diffuse sound as appears in concert halls as late reverberation has a level that is nearly independent of position (for relatively small displacements). Thus, the level difference of the diffuse sound between two channels is always about 0 dB. Second, this has the nice side effect that, when $\Delta L_{12}(k)$ is very large, only diffuse sound is mixed into the weaker channel. Thus, the sound of the stronger channel is modified minimally, reducing negative effects of the long convolutions, such as time spreading of transients.

Non-negative solutions for Equations (17)-(20) yield the following equations for the scale factors:

$$\begin{aligned}
a_1 &= \sqrt{\frac{10^{\frac{\Delta L_{12}(k)}{10}} + c_{12}(k)10^{\frac{\Delta L_{12}(k)}{20}} - 1}{2\left(10^{\frac{\Delta L_{12}(k)}{10}} + 1\right)}}\\
a_2 &= \sqrt{\frac{-10^{\frac{\Delta L_{12}(k)}{10}} + c_{12}(k)10^{\frac{\Delta L_{12}(k)}{20}} + 1}{2\left(10^{\frac{\Delta L_{12}(k)}{10}} + 1\right)}}\\
b_1 &= \sqrt{\frac{\left(10^{\frac{\Delta L_{12}(k)}{10}} + c_{12}(k) - 10^{\frac{\Delta L_{12}(k)}{20}} + 1\right)p_{\tilde{s}}(k)}{2\left(10^{\frac{\Delta L_{12}(k)}{10}} + 1\right)p_{\tilde{s}_1}(k)}}\\
b_2 &= \sqrt{\frac{\left(10^{\frac{\Delta L_{12}(k)}{10}} + c_{12}(k) - 10^{\frac{\Delta L_{12}(k)}{20}} + 1\right)p_{\tilde{s}}(k)}{2\left(10^{\frac{\Delta L_{12}(k)}{10}} + 1\right)p_{\tilde{s}_2}(k)}}
\end{aligned} \tag{21}$$

Multi-Channel BCC Synthesis

Although the configuration shown in FIG. 7 generates two output channels, the configuration can be extended to any greater number of output channels by replicating the configuration shown in the dashed block in FIG. 7. Note that, in these embodiments of the present invention, there is one LR processor 720 for each output channel. Note further that, in these embodiments, each LR processor is implemented to operate on the combined channel in the time domain.

Figure 8:
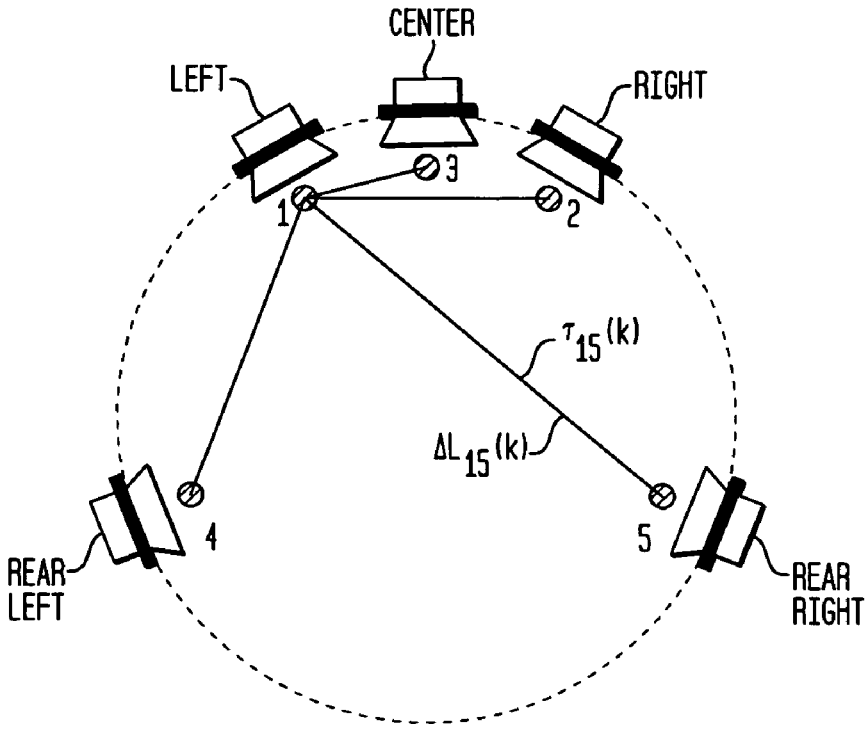
FIGS. 8-10 represents an exemplary five-channel audio system.

FIG. 8 represents an exemplary five-channel audio system. It is enough to define ICLD and ICTD between a reference channel (e.g., channel number 1) and each of the other four channels, where $\Delta L_{1i}(k)$ and $\tau_{1i}(k)$ denote the ICLD and ICTD between the reference channel 1 and channel i, $2 \leqq i \leqq 5$.

Figure 9:
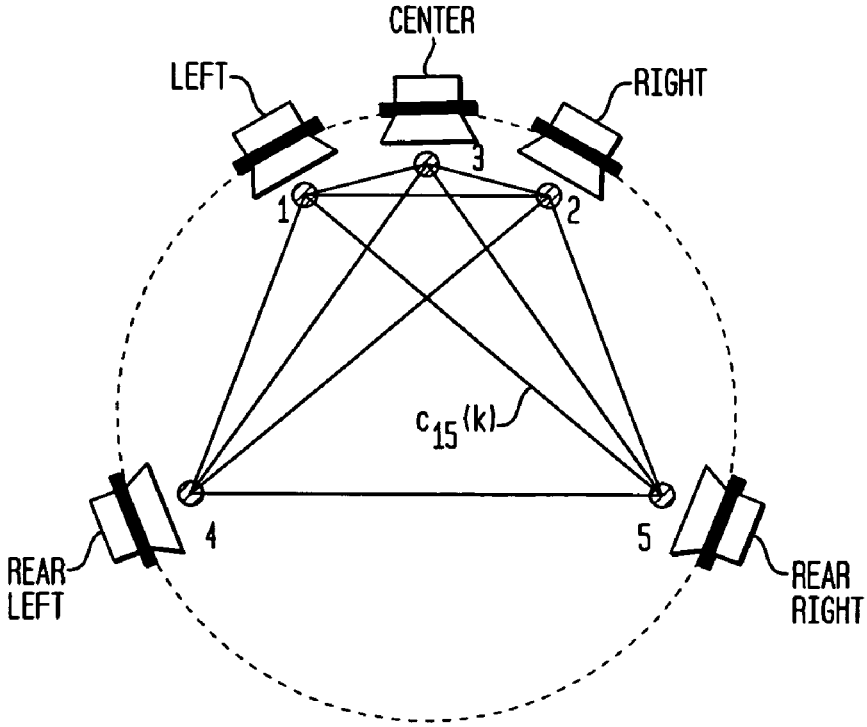

As opposed to ICLD and ICTD, ICC has more degrees of freedom. In general, the ICC can have different values between all possible input channel pairs. For C channels, there are C(C−1)/2 possible channel pairs. For example, for five channels, there are ten channel pairs as represented in FIG. 9.

Given a sub-band $\tilde{s}(k)$ of the combined signal s(n) plus the sub-bands of C−1 diffuse channels $\tilde{s}_i(k)$, where $(1 \leqq i \leqq C-1)$ and the diffuse channels are assumed to be independent, it is possible to generate C sub-band signals such that the ICC between each possible channel pair is the same as the ICC estimated in the corresponding sub-bands of the original signal. However, such a scheme would involve estimating and transmitting C(C−1)/2 ICC values for each sub-band at each time index, resulting in relatively high computational complexity and a relatively high bit rate.

Figure 10:
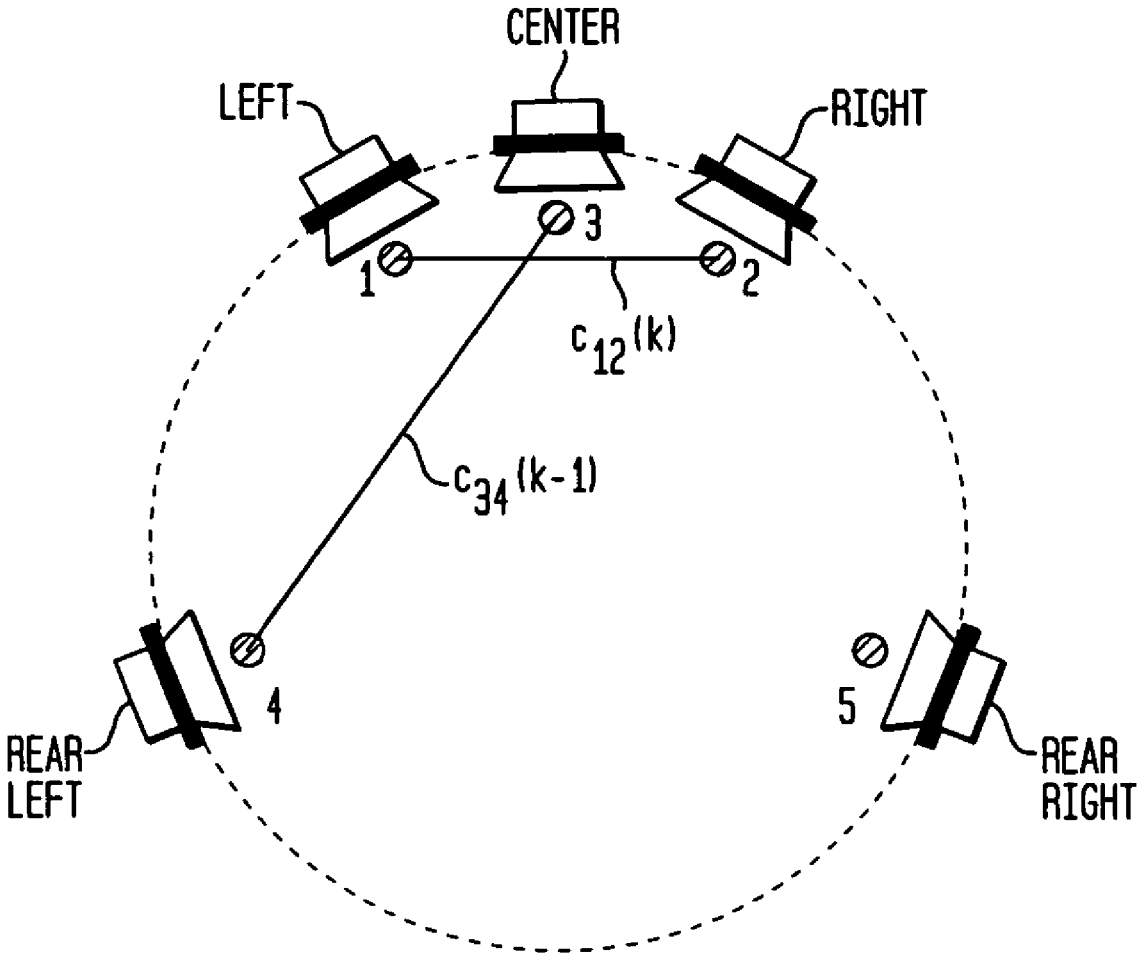

For each sub-band, the ICLD and ICTD determine the direction at which the auditory event of the corresponding signal component in the sub-band is rendered. Therefore, in principle, it should be enough to just add one ICC parameter, which determines the extent or diffuseness of that auditory event. Thus, in one embodiment, for each sub-band, at each time index k, only one ICC value corresponding to the two channels having the greatest power levels in that sub-band is estimated. This is illustrated in FIG. 10, where, at time instance k−1, the channel pair (3,4) have the greatest power levels for a particular sub-band, while, at time instance k, the channel pair (1,2) have the greatest power levels for the same sub-band. In general, one or more ICC values can be transmitted for each sub-band at each time interval.

Similar to the two-channel (e.g., stereo) case, the multi-channel output sub-band signals are computed as weighted sums of the sub-band signals of the combined signal and diffuse audio channels, as follows:

$$\begin{aligned} \tilde{x}_1(k) &= a_1\tilde{s}(k-d_1)+b_1\tilde{s}_1(k) \\ \tilde{x}_2(k) &= a_2\tilde{s}(k-d_2)+b_2\tilde{s}_2(k) \\ &\vdots \\ \tilde{x}_C(k) &= a_C\tilde{s}(k-d_C)+b_C\tilde{s}_C(k) \end{aligned} \quad (22)$$

The delays are determined from the ICTDs as follows:

$$d_i = \begin{cases} -\min_{1\le l<C}\tau_{1l}(k) & i=1 \\ \tau_{1l}(k)+d_1 & 2\le i\le C \end{cases}. \quad (23)$$

2C equations are needed to determine the 2C scale factors in Equation (22). The following discussion describes the conditions leading to these equations.

ICLD: C−1 equations similar to Equation (17) are formulated between the channels pairs such that the output sub-band signals have the desired ICLD cues.

ICC for the two strongest channels: Two equations similar to Equations (18) and (20) between the two strongest audio channels, $i_1$ and $i_2$, are formulated such that (1) the ICC between these channels is the same as the ICC estimated in the encoder and (2) the amount of diffuse sound in both channels is the same, respectively.

Normalization: Another equation is obtained by extending Equation (19) to C channels, as follows:

$$\sum_{i=1}^{C} a_i^2 p_{\tilde{s}}(k) + \sum_{i=1}^{C} b_i^2 p_{\tilde{s}_i}(k) = p_{\tilde{s}}(k) \quad (24)$$

ICC for C−2 weakest channels: The ratio between the power of diffuse sound to non-diffuse sound for the weakest C−2 channels ($i\neq i_1 \hat{} i\neq i_2$ ) is chosen to be the same as for the second strongest channel $i_2$, such that:

$$\frac{b_i^2 p_{\tilde{s}_i}(k)}{a_i^2 p_{\tilde{s}}(k)} = \frac{b_{i_2}^2 p_{\tilde{s}_{i_2}}(k)}{a_{i_2}^2 p_{\tilde{s}}(k)}, \quad (25)$$

resulting in another C−2 equations, for a total of 2C equations. The scale factors are the non-negative solutions of the described 2C equations.

Reducing Computational Complexity

As mentioned before, for reproducing naturally sounding diffuse sound, the impulse responses $h_i(t)$ of Equation (15) should be as long as several hundred milliseconds, resulting in high computational complexity. Furthermore, BCC synthesis requires, for each $h_i(t)$, ($1\leqq i\leqq C$ ), an additional filter bank, as indicated in FIG. 7

The computational complexity could be reduced by using artificial reverberation algorithms for generating late reverberation and using the results for $s_i(t)$. Another possibility is to carry out the convolutions by applying an algorithm based on the fast Fourier transform (FFT) for reduced computational complexity. Yet another possibility is to carry out the convolutions of Equation (14) in the frequency domain, without introducing an excessive amount of delay. In this case, the same short-time Fourier transform (STFT) with overlapping windows can be used for both the convolutions and the BCC processing. This results in lower computational complexity of the convolution computation and no need to use an additional filter bank for each $h_i(t)$. The technique is derived for a single combined signal s(t) and a generic impulse response h(t).

The STFT applies discrete Fourier transforms (DFTs) to windowed portions of a signal s(t). The windowing is applied at regular intervals, denoted window hop size N. The resulting windowed signal with window position index k is:

$$s_k(t) = \begin{cases} w(t-kN)s(t), & kN \le t \le kN+W \\ 0, & \text{otherwise} \end{cases}, \quad (26)$$

where W is the window length. A Hann window can be used with length W=512 samples and a window hop size of N=W/2 samples. Other windows can be used that fulfill the (in the following, assumed) condition:

$$s(t) = \sum_{k=-\infty}^{\infty} s_k(t) \quad (27)$$

Figure 11A:
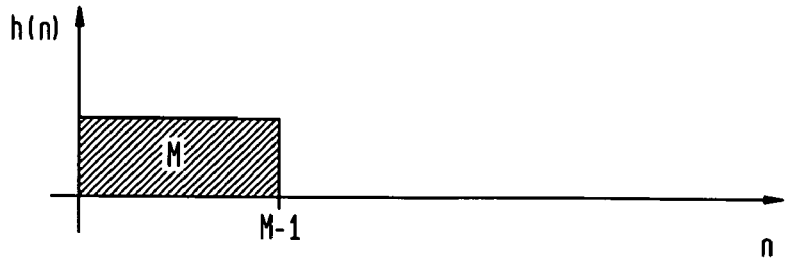
FIGS. 11 and 12 graphically illustrate the timing of late reverberation filtering and DFT transforms.
Figure 11B:
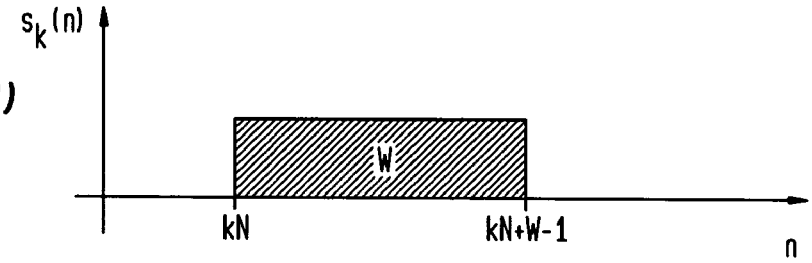
Figure 11C:
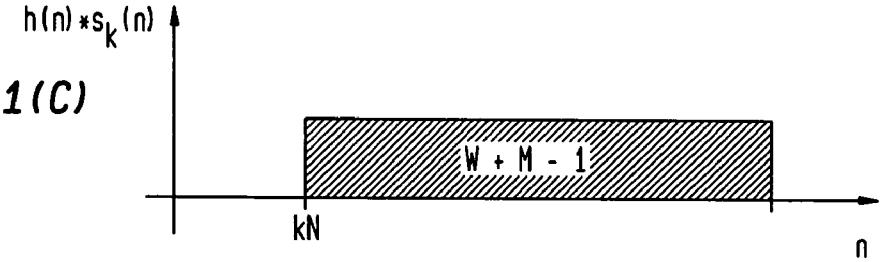

First, the simple case of implementing a convolution of the windowed signal $s_k(t)$ in the frequency domain is considered. FIG. 11(A) illustrates the non-zero span of an impulse response h(t) of length M. Similarly, the non-zero span of $s_k(t)$ is illustrated in FIG. 11(B). It is easy to verify that $h(t)*s_k(t)$ has a non-zero span of W+M−1 samples as illustrated in FIG. 11(C).

Figure 12A:
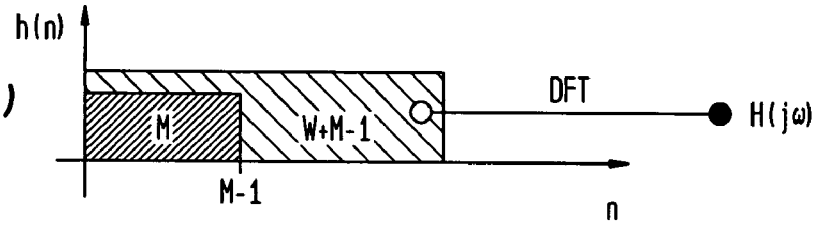
Figure 12B:
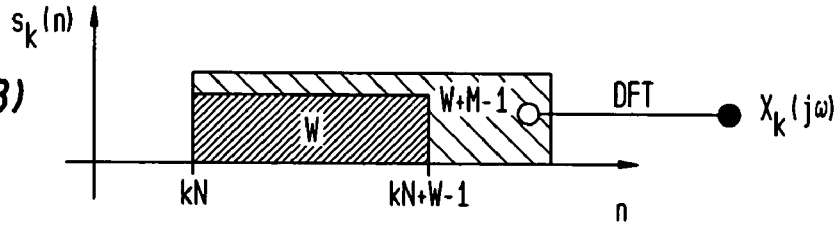
Figure 12C:
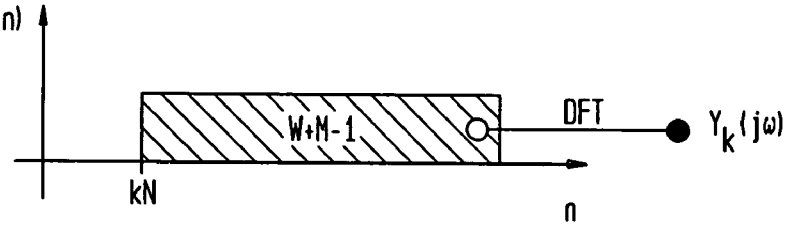

FIGS. 12(A)-(C) illustrate at which time indices DFTs of length W+M−1 are applied to the signals h(t), $s_k(t)$, and $h(t)*s_k(t)$, respectively. FIG. 12(A) illustrates that H(jω) denotes the spectrum obtained by applying the DFT starting at time index t=0 to h(t). FIGS. 12(B) and 12(C) illustrate the computation of $X_k(j\omega)$ and $Y_k(j\omega)$ from $s_k(t)$ and $h(t)*s_k(t)$, respectively, by applying the DFTs starting at time index t=kN. It can easily be shown that $Y_k(j\omega)=H(j\omega)X_k(j\omega)$. That is, because the zeros at the end of the signals h(t) and $s_k(t)$ result in the circular convolution imposed on the signals by the spectrum product being equal to linear convolution.

From the linearity property of convolution and Equation (27), it follows that:

$$h(t)*s(t)=\sum_{k=-\infty}^{\infty}h(t)*s_k(t). \tag{28}$$

Thus, it is possible to implement a convolution in the domain of the STFT by computing, at each time t, the product $H(j\omega)X_k(j\omega)$ and applying the inverse STFT (inverse DFT plus overlap/add). A DFT of length W+M−1 (or longer) should be used with zero padding as implied by FIG. 12. The described technique is similar to overlap/add convolution with the generalization that overlapping windows can be used (with any window fulfilling the condition of Equation (27)).

The described method is not practical for long impulse responses (e.g., M>>W), since then a DFT of a much larger size than W needs to be used. In the following, the described method is extended such that only a DFT of size W+N−1 needs to be used.

A long impulse response h(t) of length M=LN is partitioned into L shorter impulse responses $h_l(t)$, where:

$$h_l(t)=\begin{cases}h(t+lN), & 0\le t<N\\ 0, & \text{otherwise}\end{cases} \tag{29}$$

If mod(M, N)≠0, then N−mod(M, N) zeroes are added to the tail of h(t). The convolution with h(t) can then be written as a sum of shorter convolutions, as follows:

$$h(t)*s(t)=\sum_{l=0}^{L-1}h_l(t)*s(t-lN). \tag{30}$$

Applying Equations (29) and (30), at the same time, yields:

$$h(t)*s(t)=\sum_{k=-\infty}^{\infty}\sum_{l=0}^{L-1}h_l(t)*s_k(t-lN). \tag{31}$$

The non-zero time span of one convolution in Equation (31), $h_l(t)*s_k(t-lN)$, as a function of k and l is $(k+l)N\leqq t<(k+l+1)N+W$. Thus, for obtaining its spectrum $\tilde{Y}_{kl}(j\omega)$, the DFT is applied to this interval (corresponding to DFT position index k+1). It can be shown that $\tilde{Y}_{kl}(j\omega)=H_l(j\omega)X_k(j\omega)$ where $X_k(j\omega)$ is defined as previously with M=N, and $H_l(j\omega)$ is defined similar to $H(j\omega)$, but for the impulse response $h_l(t)$.

The sum of all spectra $\tilde{Y}_{kl}(j\omega)$ with the same DFT position index i=k+1 is as follows:

$$Y_i(j\omega)=\sum_{k+l=i}\tilde{Y}_{k+l}(j\omega) \tag{32}$$

-continued $$=\sum_{l=0}^{L-1}H_l(j\omega)X_{i-l}(j\omega).$$

Thus, the convolution $h(t)*s_k(t)$ is implemented in the STFT domain by applying Equation (32) at each spectrum index i to obtain $Y_i(j\omega)$. The inverse STFT (inverse DFT plus overlap/add) applied to $Y_i(j\omega)$ is equal to the convolution [illegible], as desired.

Note that, independently of the length of h(t), the amount of zero padding is upper bounded by N−1 (one sample less than the STFT window hop size). DFTs larger than W+N−1 can be used if desired (e.g., using an FFT with a length equal to a power of two).

As mentioned before, low-complexity BCC synthesis can operate in the STFT domain. In this case, ICLD, ICTD, and ICC synthesis is applied to groups of STFT bins representing spectral components with bandwidths equal or proportional to the bandwidth of a critical band (where groups of bins are denoted "partitions"). In such a system, for reduced complexity, instead of applying the inverse STFT to Equation (32), the spectra of Equation (32) are directly used as diffuse sound in the frequency domain.

Figure 13:
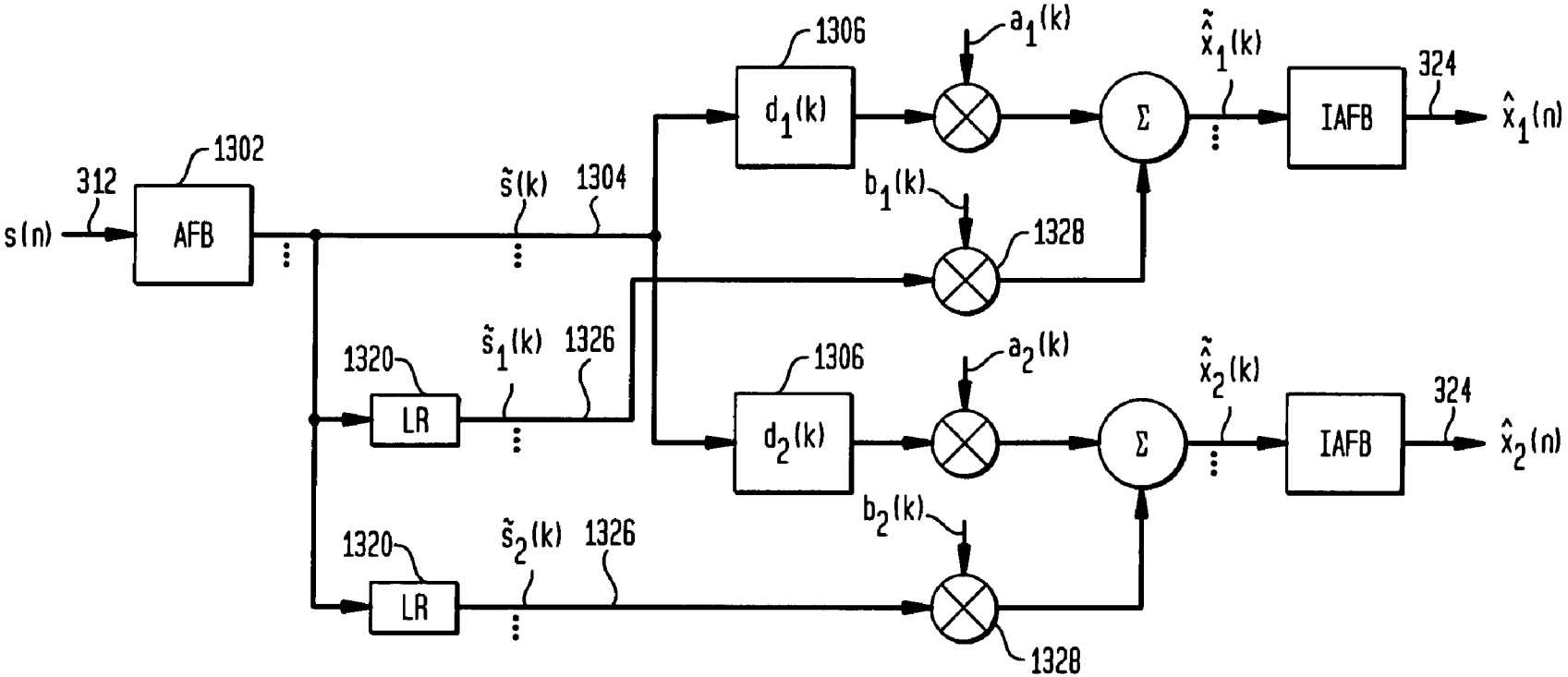
FIG. 13 shows a block diagram of the audio processing performed by the BCC synthesizer of FIG. 3 to convert a single combined channel into two synthesized audio output channels using reverberation-based audio synthesis, according to an alternative embodiment of the present invention, in which LR processing is implemented in the frequency domain.

FIG. 13 shows a block diagram of the audio processing performed by BCC synthesizer 322 of FIG. 3 to convert a single combined channel 312 (s(t)) into two synthesized audio output channels 324 ($\hat{x}_1(t)$, $\hat{x}_2(t)$) using reverberation-based audio synthesis, according to an alternative embodiment of the present invention, in which LR processing is implemented in the frequency domain. In particular, as shown in FIG. 13, AFB block 1302 converts the time-domain combined channel 312 into four copies of a corresponding frequency-domain signal 1304 ($\tilde{s}(k)$). Two of the four copies of the frequency-domain signals 1304 are applied to delay blocks 1306, while the other two copies are applied to LR processors 1320, whose frequency-domain LR output signals 1326 are applied to multipliers 1328. The rest of the components and processing of the BCC synthesizer of FIG. 13 are analogous to those of the BCC synthesizer of FIG. 7.

When the LR filters are implemented in the frequency domain, such as LR filters 1320 of FIG. 13, the possibility exists to use different filter lengths for different frequency sub-bands, for example, shorter filters at higher frequencies. This can be used to reduce overall computational complexity.

Hybrid Embodiments

Even when the LR processors are implemented in the frequency domain, as in FIG. 13, the computational complexity of the BCC synthesizer may still be relatively high. For example, if late reverberation is modeled with an impulse response, the impulse response should be relatively long in order to obtain high-quality diffuse sound. On the other hand, the coherence-based audio synthesis of the '437 application is typically less computationally complex and provides good performance for high frequencies. This leads to the possibility of implementing a hybrid audio processing system that applies the reverberation-based processing of the present invention to low frequencies (e.g., frequencies below about 1-3 kHz), while the coherence-based processing of the '437 application is applied to high frequencies (e.g., frequencies above about 1-3 kHz), thereby achieving a system that provides good performance over the entire frequency range while reducing overall computational complexity.

Alternative Embodiments

Although the present invention has been described in the context of reverberation-based BCC processing that also relies on ICTD and ICLD data, the invention is not so limited. In theory, the BCC processing of present invention can be implemented without ICTD and/or ICLD data, with or without other suitable cue codes, such as, for example, those associated with head-related transfer functions.

As mentioned earlier, the present invention can be implemented in the context of BCC coding in which more than one "combined" channel is generated. For example, BCC coding could be applied to the six input channels of 5.1 surround sound to generate two combined channels: one based on the left and rear left channels and one based on the right and rear right channels. In one possible implementation, each of the combined channels could also be based on the two other 5.1 channels (i.e., the center channel and the LFE channel). In other words, a first combined channel could be based on the sum of the left, rear left, center, and LFE channels, while the second combined channel could be based on the sum of the right, rear right, center, and LFE channels. In this case, there could be two different sets of BCC cue codes: one for the channels used to generate the first combined channel and one for the channels used to generate the second combined channel, with a BCC decoder selectively applying those cue codes to the two combined channels to generate synthesized 5.1 surround sound at the receiver. Advantageously, this scheme would enable the two combined channels to be played back as conventional left and right channels on conventional stereo receivers.

Note that, in theory, when there are multiple "combined" channels, one or more of the combined channels may in fact be based on individual input channels. For example, BCC coding could be applied to 7.1 surround sound to generate a 5.1 surround signal and appropriate BCC codes, where, for example, the LFE channel in the 5.1 signal could simply be a replication of the LFE channel in the 7.1 signal.

The present invention has been described in the context of audio synthesis techniques in which two or more output channels are synthesized from one or more combined channels, where there is one LR filter for each different output channel. In alternative embodiments, it is possible to synthesize C output channels using fewer than C LR filters. This can be achieved by combining the diffuse channel outputs of the fewer-than-C LR filters with the one or more combined channels to generate C synthesized output channels. For example, one or more of the output channels might get generated without any reverberation, or one LR filter could be used to generate two or more output channels by combining the resulting diffuse channel with different scaled, delayed version of the one or more combined channels.

Alternatively, this can be achieved by applying the reverberation techniques described earlier for certain output channels, while applying other coherence-based synthesis techniques for other output channels. Other coherence-based synthesis techniques that may be suitable for such hybrid implementations are described in E. Schuijers, W. Oomen, B. den Brinker, and J. Breebaart, "Advances in parametric coding for high-quality audio," *Preprint* 114$^{th}$ *Convention Aud. Eng. Soc.*, March 2003, and Audio Subgroup, Parametric coding for High Quality Audio, *ISO/IEC JTC*1/*SC*29/*WG*11 *MPEG*2002/*N*5381, December 2002, the teachings of both of which are incorporated herein by reference.

Although the interface between BCC encoder 302 and BCC decoder 304 in FIG. 3 has been described in the context of a transmission channel, those skilled in the art will understand that, in addition or in the alternative, that interface may include a storage medium. Depending on the particular implementation, the transmission channels may be wired or wire-less and can use customized or standardized protocols (e.g., IP). Media like CD, DVD, digital tape recorders, and solid-state memories can be used for storage. In addition, transmission and/or storage may, but need not, include channel coding. Similarly, although the present invention has been described in the context of digital audio systems, those skilled in the art will understand that the present invention can also be implemented in the context of analog audio systems, such as AM radio, FM radio, and the audio portion of analog television broadcasting, each of which supports the inclusion of an additional in-band low-bitrate transmission channel.

The present invention can be implemented for many different applications, such as music reproduction, broadcasting, and telephony. For example, the present invention can be implemented for digital radio/TV/internet (e.g., Webcast) broadcasting such as Sirius Satellite Radio or XM. Other applications include voice over IP, PSTN or other voice networks, analog radio broadcasting, and Internet radio.

Depending on the particular application, different techniques can be employed to embed the sets of BCC parameters into the mono audio signal to achieve a BCC signal of the present invention. The availability of any particular technique may depend, at least in part, on the particular transmission/storage medium(s) used for the BCC signal. For example, the protocols for digital radio broadcasting usually support inclusion of additional "enhancement" bits (e.g., in the header portion of data packets) that are ignored by conventional receivers. These additional bits can be used to represent the sets of auditory scene parameters to provide a BCC signal. In general, the present invention can be implemented using any suitable technique for watermarking of audio signals in which data corresponding to the sets of auditory scene parameters are embedded into the audio signal to form a BCC signal. For example, these techniques can involve data hiding under perceptual masking curves or data hiding in pseudo-random noise. The pseudo-random noise can be perceived as "comfort noise." Data embedding can also be implemented using methods similar to "bit robbing" used in TDM (time division multiplexing) transmission for in-band signaling. Another possible technique is mu-law LSB bit flipping, where the least significant bits are used to transmit data.

BCC encoders of the present invention can be used to convert the left and right audio channels of a binaural signal into an encoded mono signal and a corresponding stream of BCC parameters. Similarly, BCC decoders of the present invention can be used to generate the left and right audio channels of a synthesized binaural signal based on the encoded mono signal and the corresponding stream of BCC parameters. The present invention, however, is not so limited. In general, BCC encoders of the present invention may be implemented in the context of converting M input audio channels into N combined audio channels and one or more corresponding sets of BCC parameters, where M>N. Similarly, BCC decoders of the present invention may be implemented in the context of generating P output audio channels from the N combined audio channels and the corresponding sets of BCC parameters, where P>N, and P may be the same as or different from M.

Although the present invention has been described in the context of transmission/storage of a single combined (e.g., mono) audio signal with embedded auditory scene parameters, the present invention can also be implemented for other numbers of channels. For example, the present invention may be used to transmit a two-channel audio signal with embedded auditory scene parameters, which audio signal can be played back with a conventional two-channel stereo receiver. In this case, a BCC decoder can extract and use the auditory scene parameters to synthesize a surround sound (e.g., based on the 5.1 format). In general, the present invention can be used to generate M audio channels from N audio channels with embedded auditory scene parameters, where M>N.

Although the present invention has been described in the context of BCC decoders that apply the techniques of the '877 and '458 applications to synthesize auditory scenes, the present invention can also be implemented in the context of BCC decoders that apply other techniques for synthesizing auditory scenes that do not necessarily rely on the techniques of the '877 and '458 applications.

The present invention may be implemented as circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A method for synthesizing an auditory scene comprising: processing at least one input channel to generate two or more processed input signals; filtering the at least one input channel to generate two or more diffuse signals; and combining the two or more diffuse signals with the two or more processed input signals to generate a plurality of output channels for the auditory scene, wherein processing the at least one input channel comprises: converting the at least one input channel from a time domain into a frequency domain to generate a plurality of frequency-domain (FD) input signals; delaying the FD input signals to generate a plurality of delayed FD signals; and scaling the delayed FD signals to generate a plurality of scaled, delayed FD signals, and wherein: the FD input signals are delayed based on inter-channel time difference (ICTD) data; and the delayed FD signals are scaled based on inter-channel level difference (ICLD) and inter-channel correlation (ICC) data.

2. The method of claim 1, wherein:

the at least one input channel is at least one combined channel generated by performing binaural cue coding (BCC) on an original auditory scene; and the ICTD, ICLD, and ICC data are cue codes derived during the BCC coding of the original auditory scene.

3. The method of claim 2, wherein the at least one combined channel and the cue codes are transmitted from an audio encoder that performs the BCC coding of the original auditory scene.

4. The method of claim 1, wherein different ICTD, ICLD, and ICC data are applied to different frequency sub-bands of the corresponding FD signals.

5. The method of claim 1, wherein:

the diffuse signals are FD signals; and the combining comprises, for each output channel:

summing one of the scaled, delayed FD signals and a corresponding one of the FD diffuse input signals to generate an FD output signal; and converting the FD output signal from the frequency domain into the time domain to generate the output channel.

6. The method of claim 5, wherein filtering the at least one input channel comprises:

applying two or more late reverberation filters to the at least one input channel to generate a plurality of diffuse channels;

converting the diffuse channels from the time domain into the frequency domain to generate a plurality of FD diffuse signals; and scaling the FD diffuse signals to generate a plurality of scaled FD diffuse signals, wherein the scaled FD diffuse signals are combined with the scaled, delayed FD input signals to generate the FD output signals.

7. The method of claim 6, wherein:

the FD diffuse signals are scaled based on ICLD and ICC data;

the at least one input channel is at least one combined channel generated by performing BCC coding on an original auditory scene; and the ICLD and ICC data are cue codes derived during the BCC coding of the original auditory scene.

8. The method of claim 7, wherein the at least one combined channel and the cue codes are transmitted from an audio encoder that performs the BCC coding of the original auditory scene.

9. The method of claim 7, wherein different ICLD and ICC data are applied to different frequency sub-bands of the corresponding FD signals.

10. The method of claim 5, wherein filtering the at least one input channel comprises:

applying two or more FD late reverberation filters to the FD input signals to generate a plurality of diffuse FD signals; and scaling the diffuse FD signals to generate a plurality of scaled diffuse FD signals, wherein the scaled diffuse FD signals are combined with the scaled, delayed FD input signals to generate the FD output signals.

11. The method of claim 10, wherein:

the diffuse FD signals are scaled based on ICLD and ICC data;

the at least one input channel is at least one combined channel generated by performing BCC coding on an original auditory scene; and the ICLD and ICC data are cue codes derived during the BCC coding of the original auditory scene.

12. The method of claim 11, wherein different ICLD and ICC data are applied to different frequency sub-bands of the corresponding FD signals.

13. The method of claim 1, wherein the method generates more than two output channels from the at least one input channel.

14. The method of claim 13, wherein the method synthesizes a surround sound auditory scene.

15. The method of claim 13, wherein a single input channel is used to synthesize the auditory scene.

16. The method of claim 1, wherein:

the method applies the processing, filtering, and combining for input channel frequencies less than a specified threshold frequency; and the method further applies alternative auditory scene synthesis processing for input channel frequencies greater than the specified threshold frequency.

17. The method of claim 16, wherein the alternative auditory scene synthesis processing involves coherence-based BCC coding without the filtering that is applied to the input channel frequencies less than the specified threshold frequency.

18. Apparatus for synthesizing an auditory scene, comprising: a configuration of at least one time domain to frequency domain (TD-FD) converter and a plurality of filters, the configuration adapted to generate two or more processed FD input signals and two or more diffuse FD signals from at least one TD input channel; two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein the configuration comprises: a first TD-FD converter adapted to convert the at least one TD input channel into a plurality of FD input signals; a plurality of delay nodes adapted to delay the FD input signals to generate a plurality of delayed FD signals; and a plurality of multipliers adapted to scale the delayed FD signals to generate a plurality of scaled, delayed FD signals, wherein the apparatus is adapted to generate more than tow output channels from the at least one TD input channel, and wherein: the delay nodes are adapted to delay the FD input signals based on inter-channel time difference (ICTD) data; and the multipliers are adapted to scale the delayed FD signals based on inter-channel level difference (ICLD) and inter-channel correlation (ICC) data.

19. The apparatus of claim 18, wherein:

the at least one input channel is at least one combined channel generated by performing binaural cue coding (BCC) on an original auditory scene; and the ICTD, ICLD, and ICC data are cue codes derived during the BCC coding of the original auditory scene.

20. The apparatus of claim 18, wherein the configuration is adapted to apply different ICTD, ICLD, and ICC data to different frequency sub-bands of the corresponding FD signals.

21. The apparatus of claim 18, wherein each filter is a TD late reverberation filter adapted to generate a different TD diffuse channel from the at least one TD input channel;

the configuration comprises, for each output channel in the auditory scene:

another TD-FD converter adapted to convert a corresponding TD diffuse channel into an FD diffuse signal; and an other multiplier adapted to scale the FD diffuse signal to generate a scaled FD diffuse signal, wherein a corresponding combiner is adapted to combine the scaled FD diffuse signal with a corresponding one of the scaled, delayed FD signals to generate one of the synthesized FD signals.

22. The apparatus of claim 21, wherein:

each other multiplier is adapted to scale the FD diffuse signal based on ICLD and ICC data;

the at least one input channel is at least one combined channel generated by performing BCC coding on an original auditory scene; and the ICLD and ICC data are cue codes derived during the BCC coding of the original auditory scene.

23. The apparatus of claim 22, wherein the configuration applies different ICLD and ICC data to different frequency sub-bands of the corresponding FD signals.

24. The apparatus of claim 18, wherein:

each filter is an FD late reverberation filter adapted to generate a different FD diffuse signal from one of the FD input signals; and the configuration further comprises a further plurality of multipliers adapted to scale the FD diffuse signals to generate a plurality of scaled FD diffuse signals, wherein the combiners are adapted to combine the scaled FD diffuse signals with the scaled, delayed FD signals to generate the synthesized FD signals.

25. The apparatus of claim 24, wherein at least two FD late reverberation filters have different filter lengths.

26. The apparatus of claim 24, wherein:

the FD diffuse signals are scaled based on ICLD and ICC data;

the at least one input channel is at least one combined channel generated by performing BCC coding on an original auditory scene; and the ICLD and ICC data are cue codes derived during the BCC coding of the original auditory scene.

27. The apparatus of claim 26, wherein the configuration applies different ICLD and ICC data to different frequency sub-bands of the corresponding FD signals.

28. The apparatus of claim 18, wherein the apparatus is adapted to synthesize a surround sound auditory scene.

29. The apparatus of claim 18, wherein the apparatus is adapted to use a single input channel to synthesize the auditory scene.

30. The apparatus of claim 18, wherein the apparatus comprises one filter for every output channel in the auditory scene.

31. The apparatus of claim 18, wherein each filter has a random frequency response with a flat spectral envelope.

32. The apparatus of claim 18, wherein:

the apparatus is adapted to generate, combine, and convert for TD input channel frequencies less than a specified threshold frequency; and the apparatus is further adapted to apply alternative auditory scene synthesis processing for TD input channel frequencies greater than the specified threshold frequency.

33. The apparatus of claim 32, wherein the alternative auditory scene synthesis processing involves coherence-based BCC coding without the filters that are applied to the TD input channel frequencies less than the specified threshold frequency.

34. A method for synthesizing an auditory scene, comprising:

processing at least one input channel to generate two or more processed input signals;

filtering the at least one input channel to generate two or more diffuse signals; and combining the two or more diffuse signals with the two or more processed input signals to generate a plurality of output channels for the auditory scene, wherein:

the method applies the processing, filtering, and combining for input channel frequencies less than a specified threshold frequency; and the method further applies alternative auditory scene synthesis processing for input channel frequencies greater than the specified threshold frequency.

35. The invention of claim 34, wherein the alternative auditory scene synthesis processing involves coherence-based BCC coding without the filtering that is applied to the input channel frequencies less than the specified threshold frequency.

36. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein:

the configuration comprises:

a first TD-FD converter adapted to convert the at least one TD input channel into a plurality of FD input signals;

a plurality of delay nodes adapted to delay the FD input signals to generate a plurality of delayed FD signals; and a plurality of multipliers adapted to scale the delayed FD signals to generate a plurality of scaled, delayed FD signals;

the delay nodes are adapted to delay the FD input signals based on inter-channel time difference (ICTD) data; and the multipliers are adapted to scale the delayed FD signals based on inter-channel level difference (ICLD) and inter-channel correlation (ICC) data.

37. The apparatus of claim 36, wherein:

the at least one input channel is at least one combined channel generated by performing binaural cue coding (BCC) on an original auditory scene; and the ICTD, ICLD, and ICC data are cue codes derived during the BCC coding of the original auditory scene.

38. The apparatus of claim 36, wherein the configuration is adapted to apply different ICTD, ICLD, and ICC data to different frequency sub-bands of the corresponding FD signals.

39. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein:

the apparatus is adapted to generate, combine, and convert for TD input channel frequencies less than a specified threshold frequency; and the apparatus is further adapted to apply alternative auditory scene synthesis processing for TD input channel frequencies greater than the specified threshold frequency.

40. The apparatus of claim 39, wherein the alternative auditory scene synthesis processing involves coherence-based BCC coding without the filters that are applied to the TD input channel frequencies less than the specified threshold frequency.

41. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein:

the configuration comprises:

a first TD-FD converter adapted to convert the at least one TD input channel into a plurality of FD input signals;

a plurality of delay nodes adapted to delay the FD input signals to generate a plurality of delayed FD signals; and a plurality of multipliers adapted to scale the delayed FD signals to generate a plurality of scaled, delayed FD signals;

the combiners are adapted to sum, for each output channel, one of the scaled, delayed FD signals and a corresponding one of the diffuse FD signals to generate one of the synthesized FD signals;

each filter is a TD late reverberation filter adapted to generate a different TD diffuse channel from the at least one TD input channel; and an other multiplier adapted to scale the FD diffuse signal to generate a scaled FD diffuse signal, wherein a corresponding combiner is adapted to combine the scaled FD diffuse signal with a corresponding one of the scaled, delayed FD signals to generate one of the synthesized FD signals; and wherein each other multiplier is adapted to scale the FD diffuse signal based on ICLD and ICC data.

42. The apparatus of claim 41, wherein:

the at least one input channel is at least one combined channel generated by performing BOG coding on an original auditory scene; and the ICLD and ICC data are cue codes derived during the BOG coding of the original auditory scene.

43. The apparatus of claim 42, wherein the configuration applies different ICLD and ICC data to different frequency sub-bands of the corresponding FD signals.

44. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein:

the configuration comprises:

a first TD-FD converter adapted to convert the at least one TD input channel into a plurality of FD input signals;

a plurality of delay nodes adapted to delay the FD input signals to generate a plurality of delayed FD signals; and a plurality of multipliers adapted to scale the delayed FD signals to generate a plurality of scaled, delayed FD signals;

the combiners are adapted to sum, for each output channel, one of the scaled, delayed FD signals and a corresponding one of the diffuse FD signals to generate one of the synthesized FD signals; each filter is an FD late reverberation filter adapted to generate a different FD diffuse signal from one of the FD input signals; and the configuration further comprises a further plurality of multipliers adapted to scale the FD diffuse signals to generate a plurality of scaled FD diffuse signals, wherein the combiners are adapted to combine the scaled FD diffuse signals with the scaled, delayed FD signals to generate the synthesized FD signals; and wherein each other multiplier is adapted to scale the FD diffuse signal based on ICLD and ICC data.

45. The apparatus of claim 44, wherein at least two FD late reverberation filters have different filter lengths.

46. The apparatus of claim 44, wherein:

the at least one input channel is at least one combined channel generated by performing BCC coding on an original auditory scene; and the ICLD and ICC data are cue codes derived during the BOG coding of the original auditory scene.

47. The apparatus of claim 46, wherein the configuration applies different ICLD and ICC data to different frequency sub-bands of the corresponding FD signals.

48. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein:

the configuration comprises:

a first TD-FD converter adapted to convert the at least one TD input channel into a plurality of FD input signals;

a plurality of delay nodes adapted to delay the FD input signals to generate a plurality of delayed FD signals; and a plurality of multipliers adapted to scale the delayed FD signals to generate a plurality of scaled, delayed FD signals;

the combiners are adapted to sum, for each output channel, one of the scaled, delayed FD signals and a corresponding one of the diffuse FD signals to generate one of the synthesized FD signals;

and the apparatus comprises one filter for every output channel in the auditory scene, and wherein: the delay nodes are adapted to delay the FD input signals based on inter-channel time difference (ICTD) data; and the multipliers are adapted to scale the delayed FD signals based on inter-channel level difference (ICLD) and inter-channel correlation (ICC) data.

49. Apparatus for synthesizing an auditory scene, comprising:

a configuration of at least one time domain to frequency domain (TD-FD) converter and a plurality of filters, the configuration adapted to generate two or more processed FD input signals and two or more diffuse FD signals from at least one TD input channel;

two or more combiners adapted to combine the two or more diffuse FD signals with the two or more processed FD input signals to generate a plurality of synthesized FD signals; and two or more frequency domain to time domain (FD-TD) converters adapted to convert the synthesized FD signals into a plurality of TD output channels for the auditory scene, wherein: the configuration comprises:

a first TD-FD converter adapted to convert the at least one TD input channel into a plurality of FD input signals;

a plurality of delay nodes adapted to delay the FD input signals to generate a plurality of delayed FD signals; and a plurality of multipliers adapted to scale the delayed FD signals to generate a plurality of scaled, delayed FD signals;

the combiners are adapted to sum, for each output channel, one of the scaled, delayed FD signals and a corresponding one of the diffuse FD signals to generate one of the synthesized FD signals;

each filter has a random frequency response with a flat spectral envelope, and wherein: the delay nodes are adapted to delay the FD input signals based on inter-channel time difference (ICTD) data; and the multipliers are adapted to scale the delayed FD signals based on inter-channel level difference (ICLD) and inter-channel correlation (ICC) data.

* * * * *

UNITED STATES PATENT AND TRADEMARK OFFICE

CERTIFICATE OF CORRECTION

PATENT NO. : 7,583,805 B2
APPLICATION NO. : 10/815591
DATED : September 1, 2009
INVENTOR(S) : Frank Baumgarte and Christof Faller It is certified that error appears in the above-identified patent and that said Letters Patent is hereby corrected as shown below:

In column 25, in line 41, please replace "tow" with --two--.

Signed and Sealed this

Tenth Day of November, 2009

David J. Kappos

David J. Kappos
*Director of the United States Patent and Trademark Office*